US012781991B2

(12) United States Patent
Mou et al.

(10) Patent No.: US 12,781,991 B2
(45) Date of Patent: Nov. 3, 2026

(54) INDOOR AIR CLEANING SYSTEM

(71) Applicant: Microjet Technology Co., Ltd., Hsinchu (TW)

(72) Inventors: Hao-Jan Mou, Hsinchu (TW); Chin-Chuan Wu, Hsinchu (TW); Chi-Feng Huang, Hsinchu (TW)

(73) Assignee: MICROJET TECHNOLOGY CO., LTD., Hsinchu (TW)

( * ) Notice: Subject to any disclaimer, the term of this patent is extended or adjusted under 35 U.S.C. 154(b) by 475 days.

(21) Appl. No.: 18/388,022

(22) Filed: Nov. 8, 2023

(65) Prior Publication Data

US 2025/0129962 A1 Apr. 24, 2025

(30) Foreign Application Priority Data

Oct. 18, 2023 (TW) ..... 112139810

(51) Int. Cl.
*F24F 11/89* (2018.01)
*F24F 8/108* (2021.01)
(Continued)

(52) U.S. Cl.
CPC ..... *F24F 11/89* (2018.01); *F24F 8/108* (2021.01); *F24F 11/64* (2018.01); *F24F 2110/52* (2018.01); *F24F 2110/64* (2018.01)

(58) Field of Classification Search
CPC .. F24F 11/89; F24F 8/108; F24F 11/64; F24F 2110/52; F24F 2110/64; F24F 8/158;
(Continued)

(56) References Cited

U.S. PATENT DOCUMENTS 5,096,477 A * 3/1992 Shinoda ..... F24F 3/167 55/385.2
10,071,177 B1 9/2018 Kellogg, Jr.
(Continued)

FOREIGN PATENT DOCUMENTS

CN 106288064 A 1/2017
CN 110440356 A 11/2019
(Continued)

OTHER PUBLICATIONS

Extended European Search Report for European Application No. 23212114.5, dated May 2, 2024.

*Primary Examiner* — Kenneth M Lo
*Assistant Examiner* — Mohammed Shafayet
(74) *Attorney, Agent, or Firm* — Birch, Stewart, Kolasch & Birch, LLP

(57) ABSTRACT

An indoor air cleaning system, including plural gas detectors which are disposed in indoor and outdoor fields for detecting air pollution information and outputting through IoT; a circulation back-flow channel; a circulation filter device disposed in the circulation back-flow channel; an air conditioning device disposed in indoor field for temperature and humidity adjustment; and a cloud calculation server device receiving the air pollution information through IoT to form a database of the air pollution information, and receiving the temperature and humidity information outputted from the air conditioning device. The cloud calculation server device compares the database and the temperature and humidity information, and outputs a control command to enable the circulation filter device, so that internal circulation directional airflows are generated in the indoor field, the air pollution is guided to pass through the circulation filter device multiple times, and the clean room ISO1~9 of indoor field is achieved.

22 Claims, 26 Drawing Sheets

(51) Int. Cl.
*F24F 11/64* (2018.01)
*F24F 110/52* (2018.01)
*F24F 110/64* (2018.01)

(58) Field of Classification Search
CPC .. F24F 8/167; F24F 8/175; F24F 8/194; F24F 8/22; F24F 3/167; F24F 2011/0002; F24F 11/0001; F24F 11/77; F24F 2110/10; F24F 2110/20; F24F 2110/50; F24F 2110/66; F24F 2110/70; F24F 2110/72; F24F 2110/74; F24F 11/58; Y02B 30/70
See application file for complete search history.

(56) References Cited

U.S. PATENT DOCUMENTS

| | | | | |
|---|---|---|---|---|
| 2018/0299159 | A1* | 10/2018 | Ajax | F24F 11/46 |
| 2022/0196269 | A1* | 6/2022 | Mou | F24F 8/30 |
| 2023/0304684 | A1 | 9/2023 | Mou et al. | |
| 2023/0366581 | A1* | 11/2023 | Hingorani | F24F 11/0001 |

FOREIGN PATENT DOCUMENTS

| | | | | | |
|---|---|---|---|---|---|
| CN | 115183346 | A | | 10/2022 | |
| CN | 115585511 | A | * | 1/2023 | F24F 5/0096 |
| JP | 3-291436 | A | | 12/1991 | |
| JP | 2006-98007 | A | | 4/2006 | |
| JP | 2015-99423 | A | | 5/2015 | |
| JP | 2022-171551 | A | | 11/2022 | |
| JP | 2023-118908 | A | | 8/2023 | |
| JP | 2023-128402 | A | | 9/2023 | |
| TW | 202331161 | A | | 8/2023 | |

* cited by examiner a a

| Maximum Number of Particles (P) | | | | | | | | | | | | |
|---|---|---|---|---|---|---|---|---|---|---|---|---|
| Class | 0.1 µm | | 0.2 µm | | 0.3 µm | | 0.5 µm | | 1 µm | | 5 µm | |
| | $P/m^3$ | $P/ft^3$ | $P/m^3$ | $P/ft^3$ | $P/m^3$ | $P/ft^3$ | $P/m^3$ | $P/ft^3$ | $P/m^3$ | $P/ft^3$ | $P/m^3$ | $P/ft^3$ |
| ISO1 | 10 | | 2 | | | | | | | | | |
| ISO2 | 100 | | 24 | | 10 | | 4 | | | | | |
| ISO3 | 1000 | 35 | 237 | 8 | 102 | 3 | 35 | 1 | 8 | | | |
| ISO4 | 10000 | 350 | 2370 | 75 | 1020 | 30 | 352 | 10 | 83 | 2 | | |
| ISO5 | 100000 | 3500 | 23700 | 750 | 10200 | 300 | 3520 | 100 | 832 | 24 | 29 | |
| ISO6 | 1000000 | 35000 | 237000 | 7500 | 102000 | 3000 | 35200 | 1000 | 8320 | 236 | 293 | 7 |
| ISO7 | | | | | | | 352000 | 10000 | 83200 | 2360 | 2930 | 70 |
| ISO8 | | | | | | | 3520000 | 100000 | 832000 | 23600 | 29300 | 700 |
| ISO9 | | | | | | | 35200000 | 1000000 | 8320000 | 236000 | 293000 | 7000 |

FIG. 13

INDOOR AIR CLEANING SYSTEM

CROSS-REFERENCE TO RELATED APPLICATION

This application claims priority to Taiwan Patent Application No. 112139810, filed on Oct. 18, 2023. The entire contents of the above-mentioned patent application are incorporated herein by reference for all purposes.

FIELD OF THE INVENTION

The present disclosure relates to an indoor air cleaning system, and more particularly to an indoor air cleaning system suitable for the gas state in the indoor field to reach the cleanliness of cleanroom classes determined through the cleanliness specifications of the number of particles.

BACKGROUND OF THE INVENTION

Suspended particles are solid particles or droplets contained in the air. Due to their extremely fine size, the suspended particles may enter the lungs of human body through the nasal hair in the nasal cavity easily, causing inflammation in the lungs, asthma or cardiovascular disease. If other pollutant compounds are attached to the suspended particles, it will further increase the harm to the respiratory system. In recent years, the problem of air pollution is getting worse. In particular, the concentration of particle matters (e.g., PM2.5) is often too high. Therefore, the monitoring to the concentration of the gas suspended particles is taken more and more seriously. However, the gas flows unstably due to the variable wind direction and the air volume, and the general gas-quality monitoring station is located in a fixed place. Under this circumstance, it is impossible for people to check the concentration of suspended particles in current environment.

Furthermore, in recent years, modern people are placing increasing importance on the quality of the air in their surroundings. For example, carbon monoxide, carbon dioxide, volatile organic compounds (VOC), PM2.5, nitric oxide, sulfur monoxide and even the suspended particles contained in the air are exposed in the environment to affect the human health, and even endanger the life seriously. Therefore, the quality of environmental air has attracted the attention of various countries. At present, how to detect the air quality and avoid the harm is a crucial issue that urgently needs to be solved.

In order to confirm the quality of the air, it is feasible to use a gas sensor to detect the air surrounding in the environment. If the detection information can be provided in real time to warn the people in the environment, it is helpful of avoiding the harm and facilitates the people to escape the hazard immediately, preventing the hazardous gas exposed in the environment from affecting the human health and causing the harm. Therefore, it is considered a valuable application to use a gas sensor to detect the air in the surrounding environment.

In addition, it is not easy to control the indoor air quality. Besides the outdoor air quality, the indoor air-conditioning conditions and the pollution sources are the major factors affecting the indoor air quality. It is necessary to intelligently and quickly detect indoor air pollution sources in various indoor fields, effectively remove the indoor air pollution to form a clean and safe breathing gas state, and monitor indoor air quality in real time anytime, anywhere. Certainly, if the concentration of the suspended particles in the indoor space field is strictly controlled according to the "clean room" standard, it allows to avoid the introduction, generation and retention of suspended particles, and the temperature and humidity in the indoor space field are controlled within the required range. That is to say, the number of suspended particles in the air pollution of the indoor space field is used to distinguish their classifications, so that it allows the indoor space field to meet the clean room requirements for safe breathing.

At present, the main application field of the clean rooms is the industrial environment. It refers to establishing a low pollution in a production facility in the indoor space and removing the pollutants such as dust particles in the air within the indoor space, so that a pretty clean environment is obtained. The number of suspended particles in the air pollution of the indoor space field is used to distinguish their classifications, and the suspended particles≥0.5 μm in per one cubic meter are accounted. Moreover, the clean rooms further have particularly strict requirements on the indoor temperature, the humidity, and the cleanliness, and they must be controlled within a certain range to meet the required production process and operating environment. The conventional clean rooms used in the industrial environments have the shortcomings of high cost, large engineering size, and power consumption. In addition, since the conventional clean rooms used in the industrial environments do not have sensors for real-time detection of air pollution around the clock, the cleaning devices need to be operated at high speed 24 hours a day. This operation method will cause a lot of energy loss and high noise environment, the conventional clean room system used in the industrial environments cannot be used in ordinary indoor home life.

Therefore, it is a main subject developed in the present disclosure to provide a solution of detecting the indoor air quality in the spaces and solving the air pollution problem, so that the indoor space field can meet the requirements of the clean room, and the impact and injury of human health caused by the gas hazards in the environment can be avoided.

SUMMARY OF THE INVENTION

One object of the present disclosure is to provide an indoor air cleaning system. In order to produce the same cleanliness of indoor air quality as the conventional clean rooms used in industrial environments, the circulation backflow channel is used in the indoor field with the circulation filter devices, the gas exchange devices, the exhaust devices, the exhaust fans and the other devices. Moreover, the gas detectors and intelligent clouds are disposed in the indoor field and the outdoor field to form an intelligent linkage system. The concentrations of PM2.5/particle numbers, the carbon dioxide and the total volatile organic compounds (TVOC) are detected through the gas detectors in the indoor field and the outdoor field to output an air pollution information. Then the cloud computing server device receives the air pollution information for calculation and comparison, and then intelligently select and automatically adjust the operating speed of the circulation filter device. In that, the pollution source is cleaned quickly, and a silent and high-efficiency operation is provided. At the same time, the linked control of the devices can be used to deal with the sudden-increasing pollution quickly. Thus, the indoor air cleaning system of the present disclosure can produce the same cleanliness of indoor air quality as the conventional clean rooms used in industrial environments, and there is no requirement to wear dustproof clothing. Currently the indoor air cleaning system of the present disclosure is the only system that can be used in general indoor living and provide the air quality similar to that of clean room.

In accordance with an aspect of the present disclosure, an indoor air cleaning system is provided, and the system includes a plurality of gas detectors, at least one circulation back-flow channel, at least one circulation filter device, at least one air conditioning device and a cloud computing server device. The plurality of gas detectors are disposed in an indoor field and an outdoor field for detecting air pollution information, wherein the plurality of gas detectors output the air pollution information through IoT communication. The at least one circulation back-flow channel is surrounded and isolated by several partitions to form on a side of the indoor field, and includes a plurality of air intakes and a plurality of back-flow vents. The at least one circulation filter device is disposed in the at least one circulation back-flow channel and corresponding to the plurality of air intakes, wherein the at least one circulation filter device includes a fan, a filter element, a gas detector and a driving control element, the gas detector receives a control command through IoT communication to the driving control element to control and actuate an operation of the fan, and the fan is controlled and actuated to guide air pollution for filtering through the filter element and discharging through the plurality of air intakes into the indoor field. The at least one air conditioning device is disposed in the indoor field for temperature and humidity adjustment, and includes a gas detector and a driving control element, wherein the gas detector receives a second control command through IoT communication to the driving control element to control and actuate an operation of the at least one air conditioning device, and externally transmit air temperature and humidity information in the indoor field. The cloud computing server device receives the air pollution information of the indoor field and the outdoor field through IoT communication for storing to form a database of the air pollution information, receives the temperature and humidity information outputted from the air conditioning device, compares by intelligent computing and intelligently selects according to the database of the air pollution information and the temperature and humidity information to output the control command to the fan of the at least one circulation filter device for actuation operation, whereby the fan of the at least one circulation filter device generates an internal circulation directional airflow continuously, and the air pollution is guided to pass through the filter element multiple times for filtration, so that gas state in the indoor field has suspended particles meeting a specific specification quantity to reach a cleanliness of clean room.

BRIEF DESCRIPTION OF THE DRAWINGS

The above contents of the present disclosure will become more readily apparent to those ordinarily skilled in the art after reviewing the following detailed description and accompanying drawings, in which:

FIG. 13 is a schematic diagram showing the classifications of the clean rooms for classifying the gas state in the indoor field of the present disclosure by counting the suspended particles with the particle size greater than 0.1 μm in per cubic meter/per cubic foot.

DETAILED DESCRIPTION OF THE PREFERRED EMBODIMENT

The present disclosure will now be described more specifically with reference to the following embodiments. It is to be noted that the following descriptions of preferred embodiments of this invention are presented herein for purpose of illustration and description only. It is not intended to be exhaustive or to be limited to the precise form disclosed.

Figure 1A:
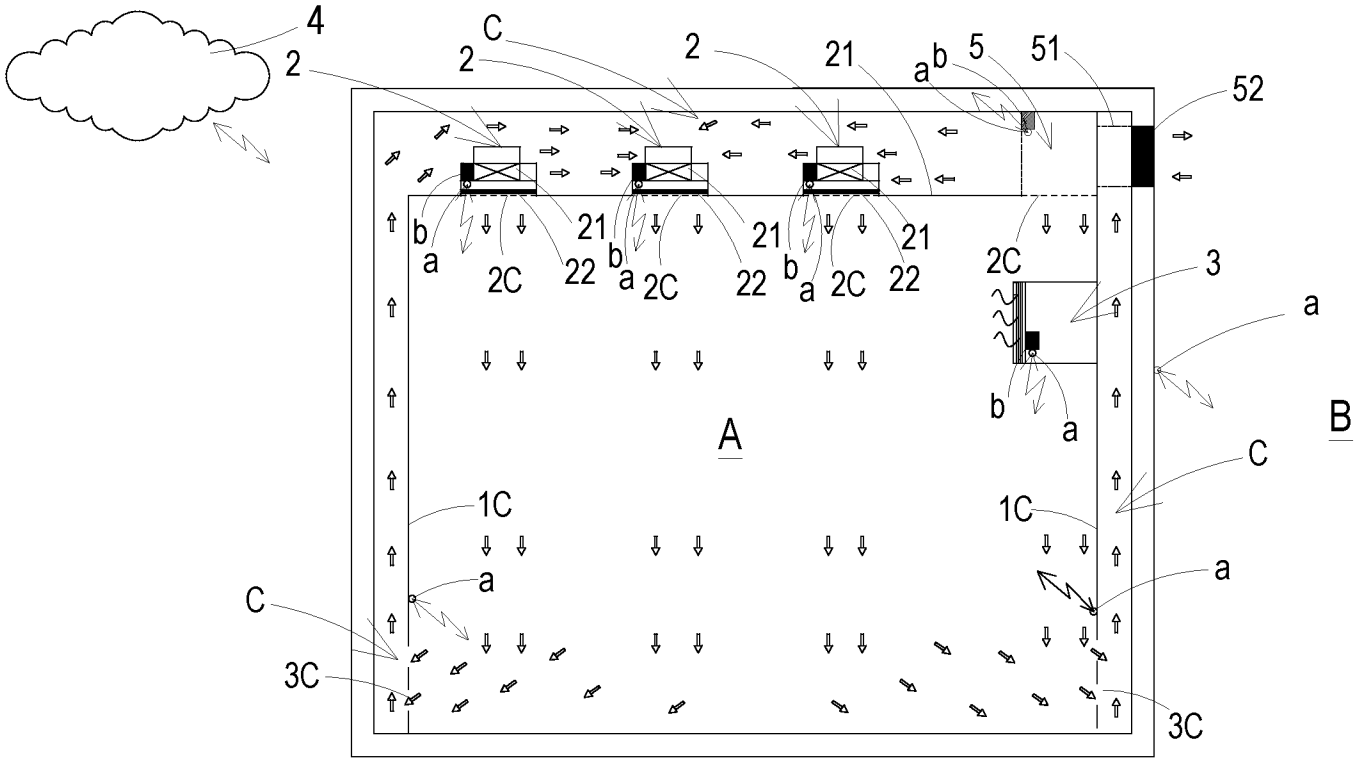
FIG. 1A is a schematic view illustrating an indoor air cleaning system implemented in an indoor field according to an embodiment of the present disclosure.
Figure 1B:
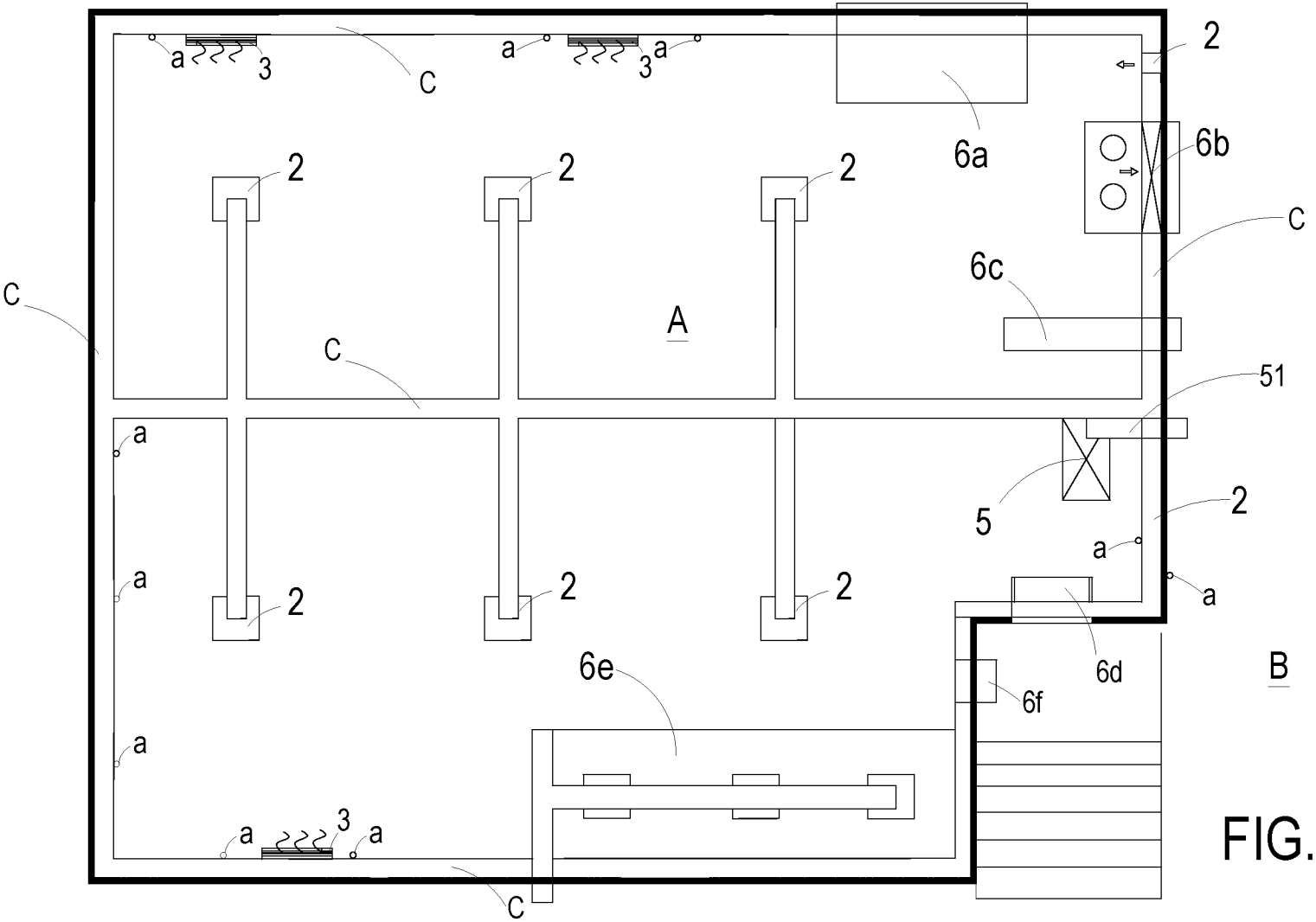
FIG. 1B is a schematic view illustrating an indoor air cleaning system implemented in an indoor field according to another embodiment of the present disclosure.

Please refer to FIG. 1A and FIG. 1B. The present disclosure provides an indoor air cleaning system. The indoor air cleaning system includes a plurality of gas detectors a, at least one circulation back-flow channel C, at least one circulation filter device 2, at least one air conditioning device 3 and a cloud computing server device 4.

Figure 3A:
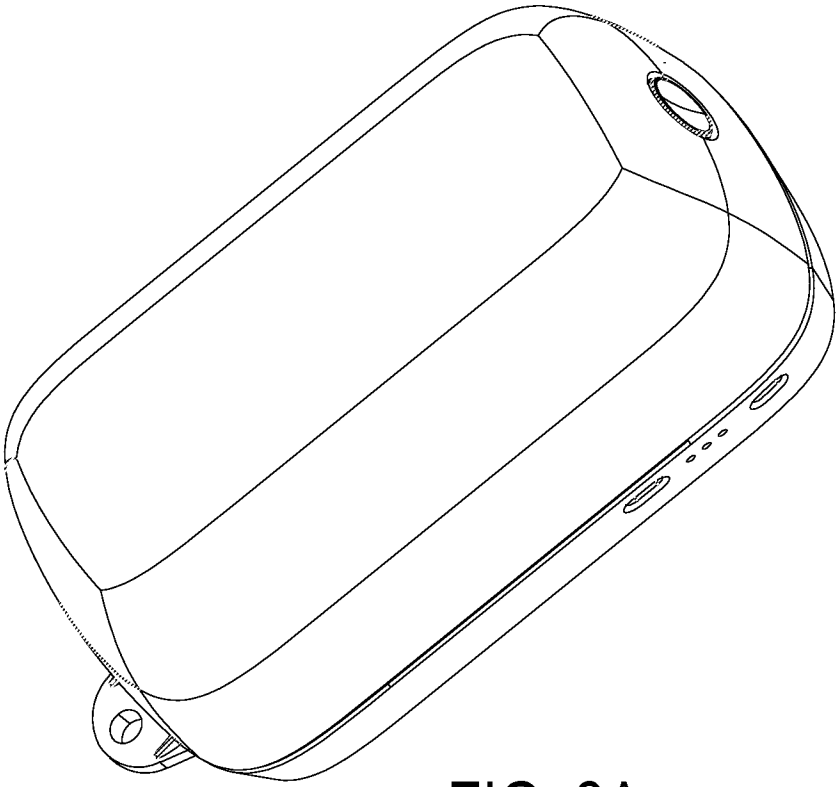
FIG. 3A is a schematic perspective view illustrating the gas detector according to the embodiment of the present disclosure.
Figure 3B:
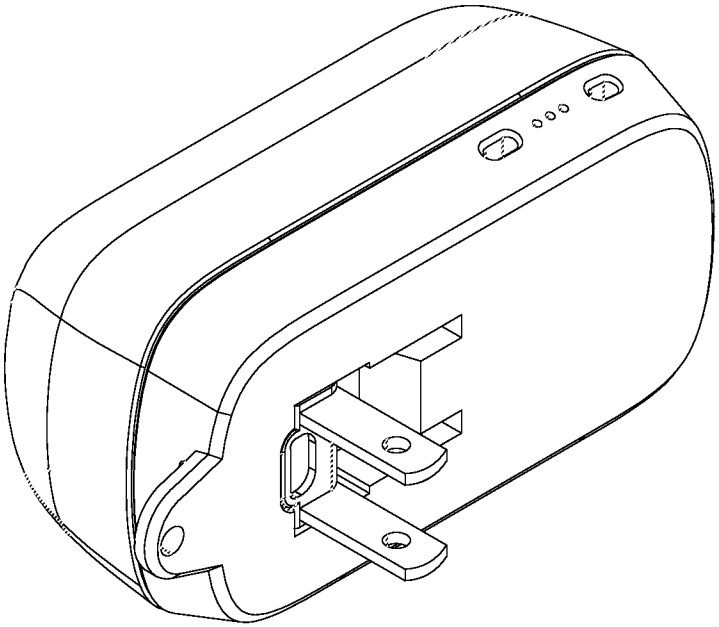
FIG. 3B is a schematic perspective view illustrating the gas detector according to the embodiment of the present disclosure and taken from another perspective.
Figure 3C:
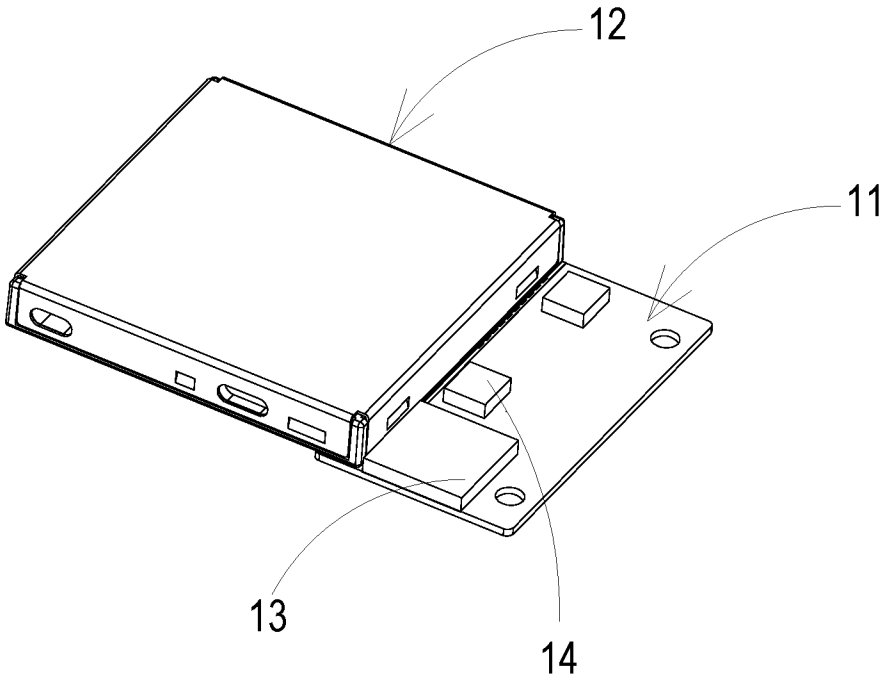
FIG. 3C is a schematic perspective view illustrating the gas detection module installed inside the gas detector according to the embodiment of the present disclosure.
Figure 4A:
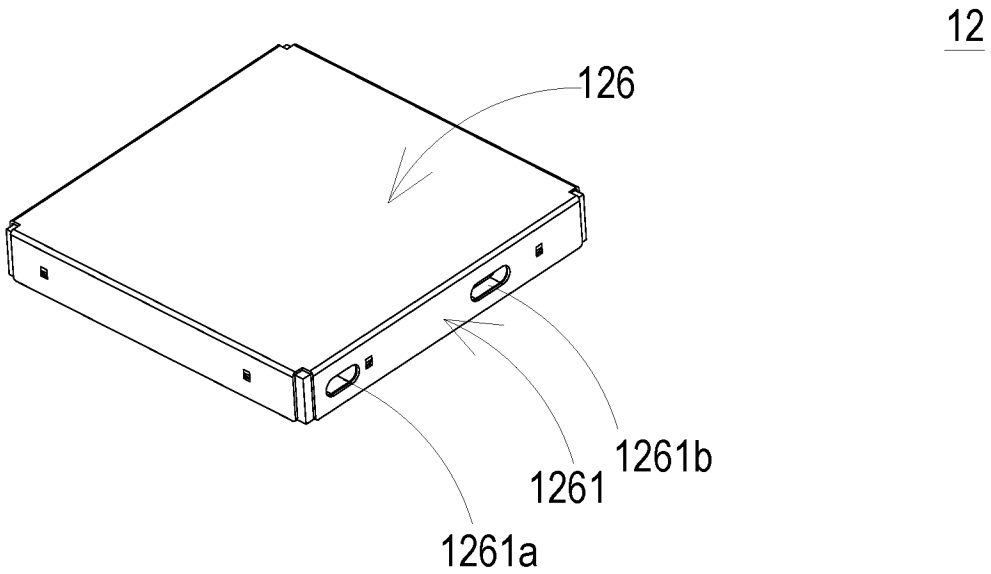
FIG. 4A is a schematic perspective view (1) illustrating the gas detection main part according to the embodiment of the present disclosure.
Figure 4B:
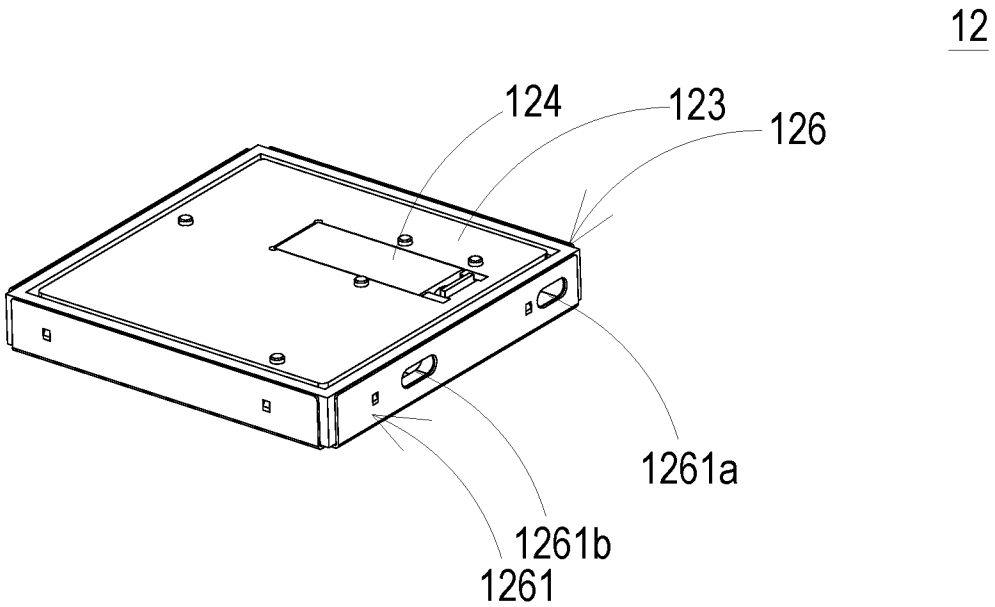
FIG. 4B is a schematic perspective view (2) illustrating the gas detection main part according to the embodiment of the present disclosure.
Figure 4C:
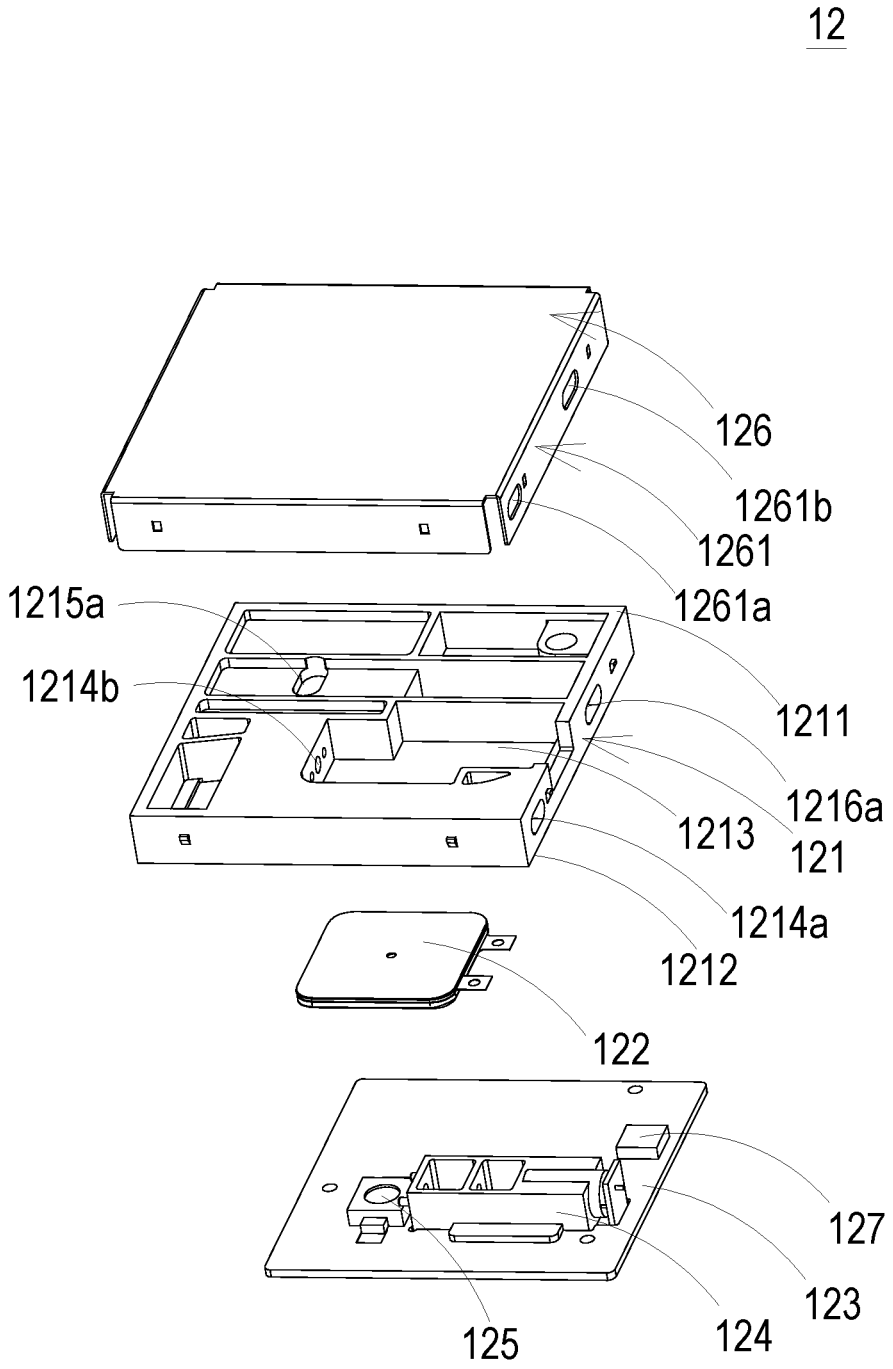
FIG. 4C is an exploded view illustrating the gas detection device according to the embodiment of the present disclosure.
Figure 5A:
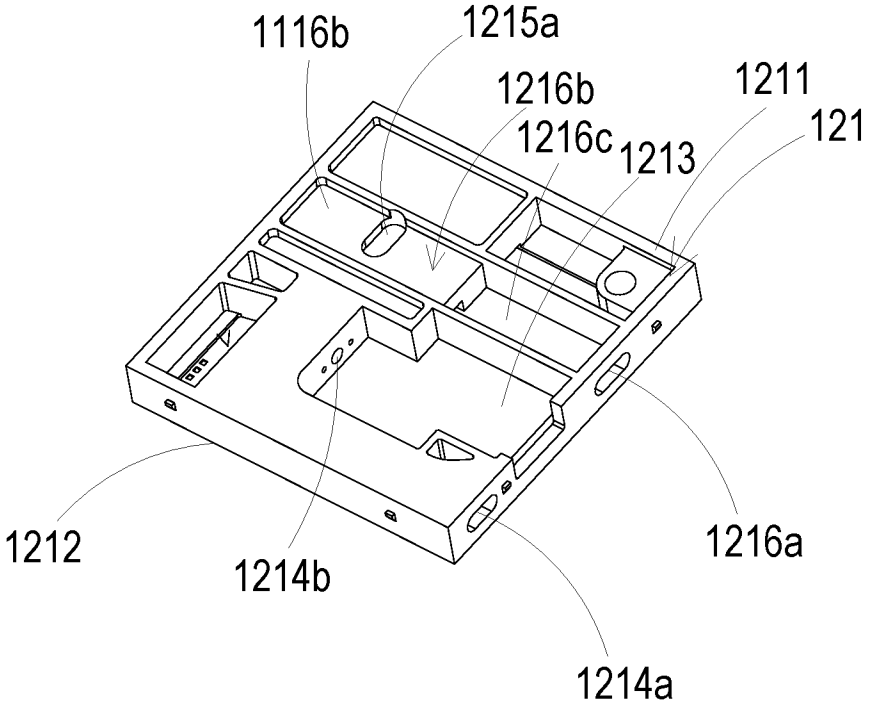
FIG. 5A is a schematic perspective view (1) illustrating the base according to the embodiment of the present disclosure.
Figure 5B:
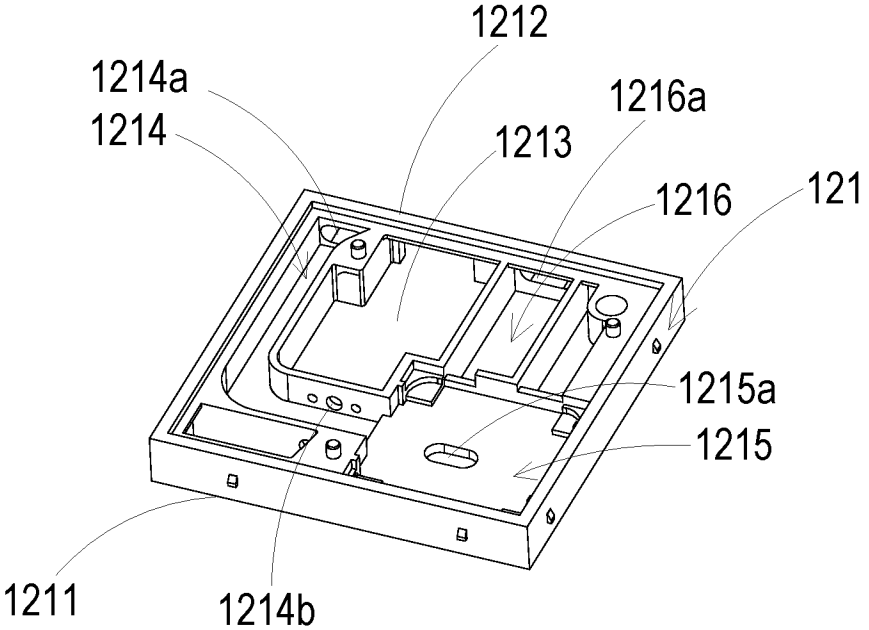
FIG. 5B is a schematic perspective view (2) illustrating the base according to the embodiment of the present disclosure.
Figure 6:
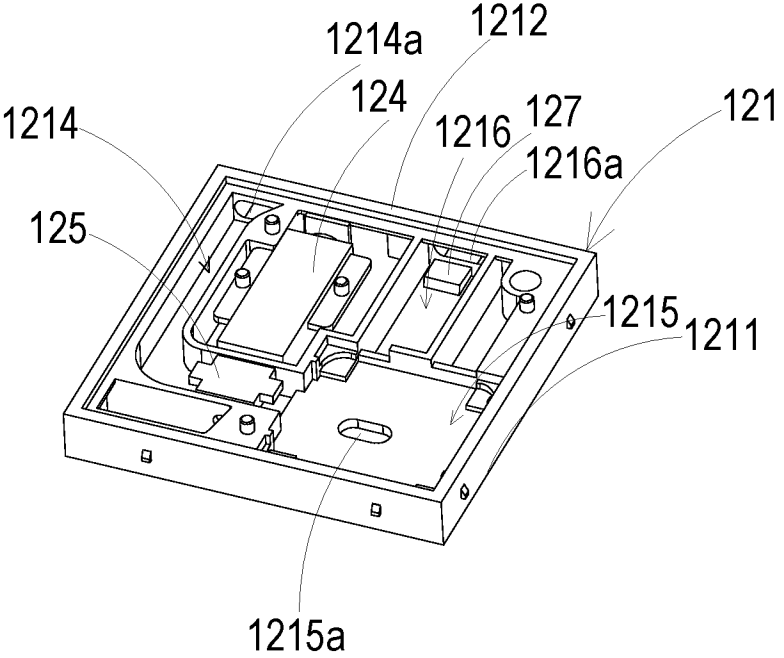
FIG. 6 is a schematic view (3) illustrating the base according to the embodiment of the present disclosure.
Figure 7A:
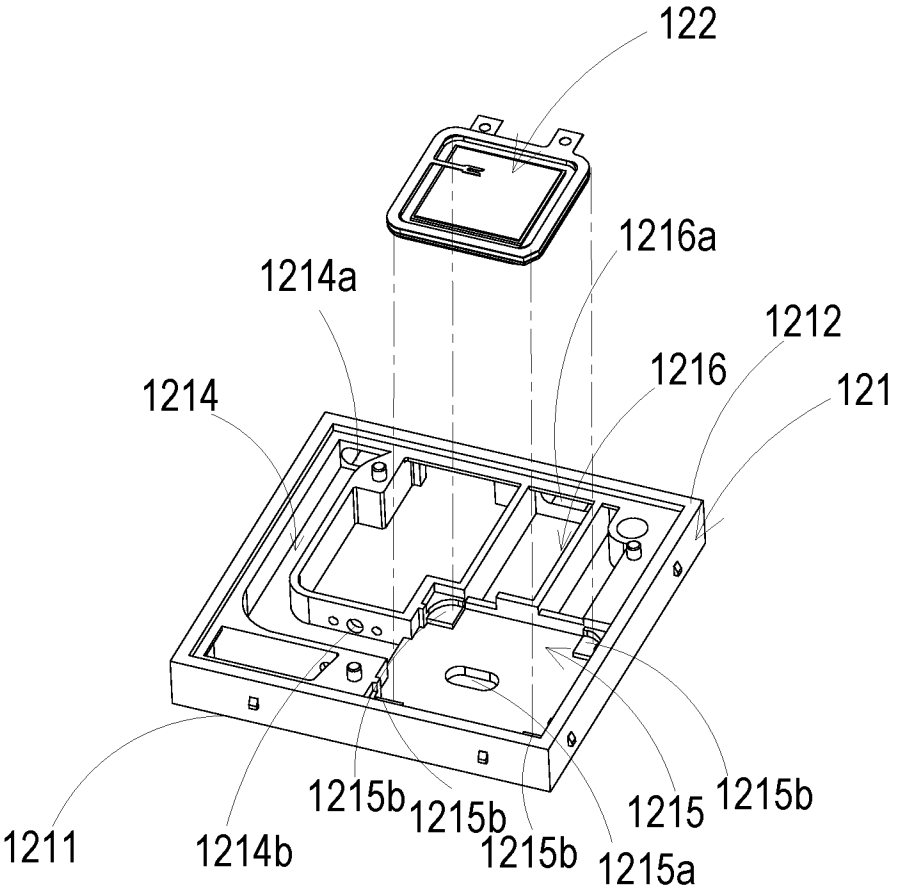
FIG. 7A is a schematic exploded view illustrating the combination of the piezoelectric actuator and the base according to the embodiment of the present disclosure.
Figure 7B:
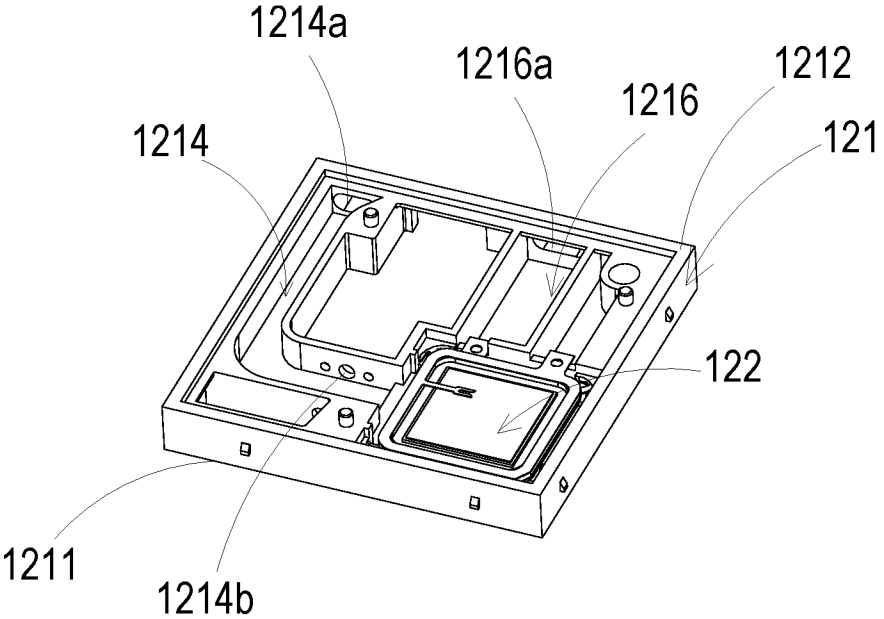
FIG. 7B is a schematic perspective view illustrating the combination of the piezoelectric actuator and the base according to the embodiment of the present disclosure.
Figure 8A:
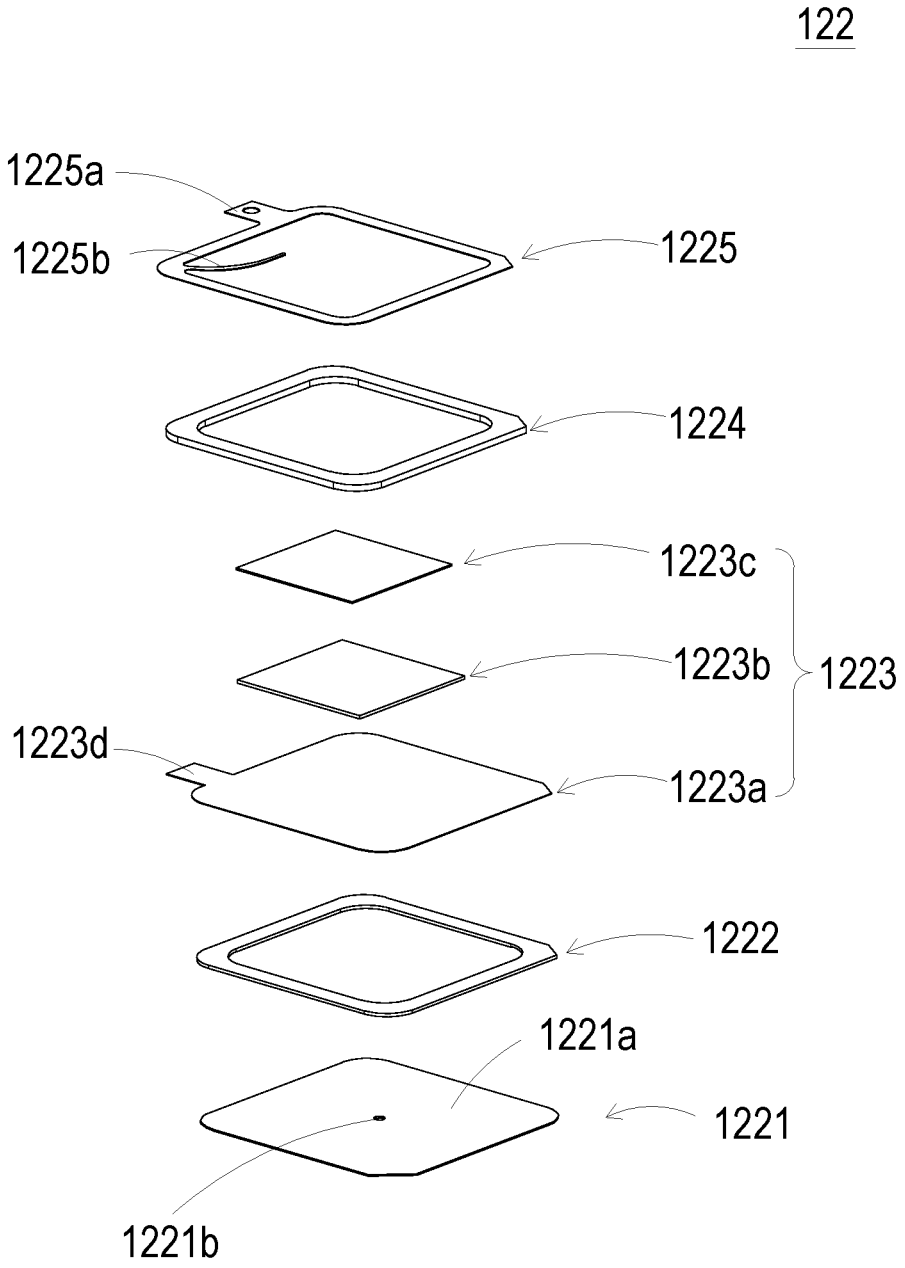
FIG. 8A is a schematic exploded view (1) illustrating the piezoelectric actuator according to the embodiment of the present disclosure.
Figure 8B:
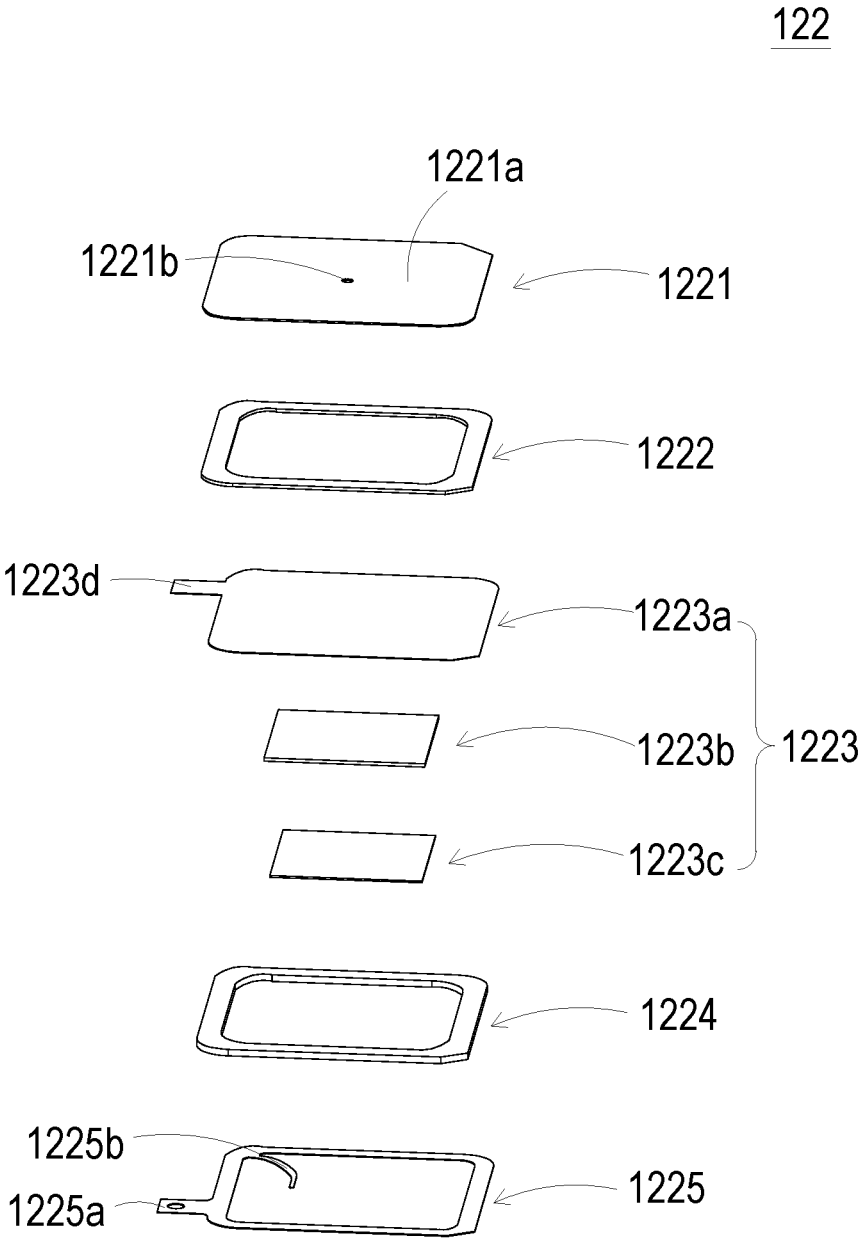
FIG. 8B is a schematic exploded view (2) illustrating the piezoelectric actuator according to the embodiment of the present disclosure.

In the embodiment, the plurality of gas detectors a are disposed in an indoor field A and an outdoor field B for detecting air pollution information. The plurality of gas detectors a output the air pollution information through IoT communication. In the embodiment, the gas detector a includes one gas detection module installed therein. Notably, please refer to FIG. 3A and FIG. 3B. In an embodiment, the gas detector a includes an external power terminal, and the external power terminal is directly inserted into the power interface in the indoor field A, so that the operation of detecting air pollution is enabled. In another embodiment, as shown in FIG. 3C, the gas detector doesn't include any external power terminal, but is installed in one device (such as a circulation filter device 2, an air conditioning device 3 and a gas exchange device 5), and connected with a driving control element b, when a control command is received by the driving control element b, the power and the actuation operation of the devices are controlled for detecting air pollution. In the embodiment, IoT communication refers to the communication technology of the collective network that connects various device and helps the devices communicate with the cloud and between the devices. Preferably but not exclusively, in an embodiment, IoT communication is a wired communication for connecting and communicating with the cloud computing server device 4 through a wired communication transmission. Preferably but not exclusively, in another embodiment, IoT communication is a wireless communication for connecting and communicating with the cloud computing server device 4 through a wireless communication transmission, and the wireless communication transmission is one selected from the group consisting of a Wi-Fi communication transmission, a Bluetooth communication transmission, a radio frequency identification communication transmission and a near field communication (NFC) transmission.

Notably, in the embodiment, the air pollution is at least one selected from the group consisting of particulate matter, carbon monoxide, carbon dioxide, ozone, sulfur dioxide, nitrogen dioxide, lead, total volatile organic compounds (TVOC), formaldehyde, bacteria, fungi, virus and a combination thereof.

In the embodiment, the at least one circulation back-flow channel C is surrounded and isolated by several partitions 1C to form on a side of the indoor field A, and includes a plurality of air intakes 2C and a plurality of back-flow vents 3C. In the embodiment, the circulation filter device 2 is disposed in the at least one circulation back-flow channel C and corresponding to the plurality of air intakes 2C. Furthermore, the circulation filter device 2 includes a fan 21, a filter element 22, a gas detector a and a driving control element b. In the embodiment, the gas detector a receives a control command through IoT communication to the driving control element b to control and actuate an operation of the fan 21. The fan 21 is controlled and actuated to guide air pollution for filtering through the filter element 22 and discharging through the plurality of air intakes 2C into the indoor field A.

In the embodiment, the air conditioning device 3 is disposed in the indoor field A for temperature and humidity adjustment, and includes a gas detector a and a driving control element b. Preferably but not exclusively, in the embodiment, the air conditioning device 3 maintains the temperature and humidity adjustment at a temperature of 25° C.±3° C. and a humidity of 50%±10%, which is regarded as a temperature and humidity set safety value. When the gas detector a directly detects that the air pollution information of the indoor field A exceeds the temperature and humidity set safety value, the gas detector a issues a control command to the driving control element b to control an actuation operation of the air conditioning device 3, so that the temperature and humidity adjustment is implemented in the indoor field A to maintain a comfortable living environment with temperature and humidity. In another embodiment, when the air pollution information detected by the plurality of gas detector a in the indoor field A is transmitted to the cloud computing server device 4 through IoT communication for intelligent computing comparison, and the air pollution information exceeds the temperature and humidity set safety value of the temperature of 25° C.±3° C. and the humidity of 50%±10%, the cloud computing server device 4 intelligently selects and issues the control command to the gas detector a through IoT communication, and the control command is further transmitted to the driving control element b for controlling an actuation operation of the air conditioning device 3, so that the temperature and humidity adjustment is implemented in the indoor field A to maintain the comfortable living environment with temperature and humidity. Notably, the air conditioning device 3 maintains the temperature and humidity adjustment at the temperature of 25° C.±3° C. and the humidity of 50%±10%.

In the embodiment, the cloud computing server device 4 receives the air pollution information of the indoor field A and the outdoor field B through IoT communication for storing to form a database of the air pollution information, receiving the temperature and humidity information outputted from the air conditioning device 3, the database of the air pollution information, the temperature and humidity information are compared by intelligent computing and intelligently selects to output the control command to the fan 21 of the circulation filter device 2 for actuation operation. Whereby, the fan 21 of the circulation filter device 2 generates an internal circulation directional airflow continuously, and the air pollution is guided to pass through the filter element 22 multiple times for filtration, so that gas state in the indoor field has the number of suspended particles greater than 0.1 μm in per cubic meter/per cubic foot to meet a specific specification quantity and reach a cleanliness of clean room ISO1~9. Notably, in the embodiment, the intelligently computing includes artificial intelligence (AI) computing or/and edge computing.

Furthermore, as shown in FIG. 1B, in order to prevent the affection and harm of human health by carbon dioxide ($CO_2$) from the indoor field A, at least one gas exchange device 5 is further disposed in the indoor field A to introduce gas from the outdoor field B into the indoor field A for ventilation. The gas exchange device 5 is disposed in the circulation backflow channel C, corresponds to the plurality of air intakes 51, and communicates with the outdoor field B through an air intake channel 51. In the embodiment, the gas exchange device 5 includes a gas detector a and a driving control element b. The gas detector a directly detects if the air pollution information of the indoor field A exceeds a pollution threshold safety value of carbon dioxide ($CO_2$) air pollution data. In the embodiment, the carbon dioxide ($CO_2$) air pollution data is maintained to less than 800 PPM, so as to meet the pollution threshold safety value. When the gas detector a detects that the air pollution information of the indoor field A exceeds the pollution threshold safety value of carbon dioxide ($CO_2$) air pollution data, a control command is issued directly to the driving control element b to control an actuation operation of the gas exchange device 5, so that gas from the outdoor field B is introduced into the indoor field A for ventilation. In another embodiment, when the air pollution information detected by the plurality of gas detector a in the indoor field A is transmitted to the cloud computing server device 4 through IoT communication for intelligent computing comparison, and the air pollution information of carbon dioxide ($CO_2$) air pollution data exceeds the pollution threshold safety value of carbon dioxide ($CO_2$) air pollution data, the cloud computing server device 4 intelligently selects and issues the control command to the gas detector a through IoT communication, and the control command is further transmitted to the driving control element b for controlling an actuation operation of the gas exchange device 5, so that gas from the outdoor field B is introduced into the indoor field A for ventilation. Notably, the indoor air cleaning system further includes a valve 52 disposed between the air intake channel 51 in communication with the gas exchange device 5 and the outdoor field B, and controlled by the driving control element b. When the gas detector a receives a control command and transmits the control command to the driving control element b for controlling an actuation operation of the gas exchange device 5 and controlling the opening of the valve 51 simultaneously, so that the air intake channel 51 is in communication with gas in the outdoor field B, and the gas from the outdoor field B is introduced into the indoor field A for ventilation. Notably, in the embodiment, the air pollution information detected in the indoor field A and the outdoor field B is carbon dioxide ($CO_2$) air pollution data. When the cloud computing server device 4 receives the air pollution information detected in the indoor field A and the outdoor field B, and intelligently compares based on the database of the air pollution information, the air pollution information of carbon dioxide ($CO_2$) detected in indoor area A must be maintained below 800 PPM to prevent the carbon dioxide ($CO_2$) in indoor area A from affecting human health and harming people. Furthermore, when the air pollution information of carbon dioxide ($CO_2$) detected in indoor area A exceeds 800 PPM, and the air pollution information of the indoor field A is higher than the air pollution information of the outdoor field B, the cloud computing server device 4 issues the control command to the gas detector a of the gas exchange device 5 through IoT communication, and the control command is received to the driving control element b to control an actuation operation of the gas exchange device 5, so that gas from the outdoor field B is introduced into the indoor field A for ventilation. Notably, in the embodiment, the gas exchange device 5 is a fresh fan, but the present disclosure is not limited thereto.

As can be seen from the above descriptions, the cloud computing server device 4 of the indoor air cleaning system of the present disclosure is used to receive and store the air pollution information of the indoor field A and the outdoor field B through IoT communication to form a big database of air pollution information, and receive the temperature and humidity information outputted from the air conditioning device 3. The intelligent computing comparison based on the database of the air pollution information and the temperature and humidity information is performed to intelligently select and output the control command to the fan 21 of the circulation filter device 2 for actuation operation. Whereby, the fan 21 of the circulation filter device 2 generates an internal circulation directional airflow continuously in the indoor field A, and the air pollution is guided to pass through the filter element 22 multiple times for filtration. In other words, the cloud computing server device 4 intelligently computes the cleanliness according to the number of suspended particles passing through the indoor field in real time, intelligently selects and issues the control command to transmit to the plurality of the circulation filter devices 2, and timely adjusts and controls the fan 21 of the circulation filter device 2 for actuation, so as to randomly change and adjust the airflow volume and the actuation time period based on the cleanliness of the number of suspended particles in real time. Whereby, the cleaning efficiency of the indoor field A is improved, the environmental noise of the indoor field A is reduced, the internal circulation directional airflow is generated in the indoor field A to generate, and the air pollution is guided to pass through the filter element 22 multiple times for filtration, so that the gas state in the indoor field A has the number of suspended particles greater than 2.5 μm in per cubic meter/per cubic foot to reach a cleanliness of clean room ISO1~9.

As shown in FIG. 13, it defines the classifications of the clean rooms for classifying the gas state in the indoor field A of the present disclosure by counting the suspended particles with the particle size greater than 0.1 μm in per cubic meter/per cubic foot. In the indoor air cleaning system of the present disclosure, the gas state in the indoor field A is allowed to have the number of suspended particles greater than 0.1 μm in per cubic meter/per cubic foot to be less than that of the cleanliness specification and reach the cleanliness of clean room ISO 1~9. The cleanliness of clean room ISO1~9 is described as follows.

The indoor air cleaning system of the present disclosure allows the gas state in the indoor field A to have the number of suspended particles greater than 0.1 μm in per cubic meter to be less than 10, or the number of suspended particles greater than 0.2 μm in per cubic meter to be less than 2, so as to reach the cleanliness of clean room ISO1. Furthermore, it allows the gas state in the indoor field A to have the number of suspended particles greater than 0.1 μm in per cubic meter to be less than 100, the number of suspended particles greater than 0.2 μm in per cubic meter to be less than 24, the number of suspended particles greater than 0.3 μm in per cubic meter to be less than 10, or the number of suspended particles greater than 0.5 μm in per cubic meter to be less than 4, so as to reach the cleanliness of clean room ISO2.

The indoor air cleaning system of the present disclosure allows the gas state in the indoor field A to have the number of suspended particles greater than 0.1 μm in per cubic meter to be less than 1000, the number of suspended particles greater than 0.1 μm in per cubic foot to be less than 35, the number of suspended particles greater than 0.2 μm in per cubic meter to be less than 237, the number of suspended particles greater than 0.2 μm in per cubic foot to be less than 8, the number of suspended particles greater than 0.3 μm in per cubic meter to be less than 102, the number of suspended particles greater than 0.3 μm in per cubic foot to be less than 3, the number of suspended particles greater than 0.5 μm in per cubic meter to be less than 35, the number of suspended particles greater than 0.5 μm in per cubic foot to be less than 1, or the number of suspended particles greater than 1 μm in per cubic meter to be less than 8, so as to reach the cleanliness of clean room ISO3.

The indoor air cleaning system of the present disclosure allows the gas state in the indoor field A to have the number of suspended particles greater than 0.1 μm in per cubic meter to be less than 10000, the number of suspended particles greater than 0.1 μm in per cubic foot to be less than 350, the number of suspended particles greater than 0.2 μm in per cubic meter to be less than 2370, the number of suspended particles greater than 0.2 μm in per cubic foot to be less than 75, the number of suspended particles greater than 0.3 μm in per cubic meter to be less than 1020, the number of suspended particles greater than 0.3 μm in per cubic foot to be less than 30, the number of suspended particles greater than 0.5 μm in per cubic meter to be less than 352, the number of suspended particles greater than 0.5 μm in per cubic foot to be less than 10, the number of suspended particles greater than 1 μm in per cubic meter to be less than 83, or the number of suspended particles greater than 1 μm in per cubic foot to be less than 2, so as to reach the cleanliness of clean room ISO4.

The indoor air cleaning system of the present disclosure allows the gas state in the indoor field A to have the number of suspended particles greater than 0.1 μm in per cubic meter to be less than 100000, the number of suspended particles greater than 0.1 μm in per cubic foot to be less than 3500, the number of suspended particles greater than 0.2 μm in per cubic meter to be less than 23700, the number of suspended particles greater than 0.2 μm in per cubic foot to be less than 750, the number of suspended particles greater than 0.3 μm in per cubic meter to be less than 10200, the number of suspended particles greater than 0.3 μm in per cubic foot to be less than 300, the number of suspended particles greater than 0.5 μm in per cubic meter to be less than 3520, the number of suspended particles greater than 0.5 μm in per cubic foot to be less than 100, the number of suspended particles greater than 1 μm in per cubic meter to be less than 832, the number of suspended particles greater than 1 μm in per cubic foot to be less than 24, or the number of suspended particles greater than 5 μm in per cubic meter to be less than 29, so as to reach the cleanliness of clean room ISO5.

The indoor air cleaning system of the present disclosure allows the gas state in the indoor field A to have the number of suspended particles greater than 0.1 μm in per cubic meter to be less than 1000000, the number of suspended particles greater than 0.1 μm in per cubic foot to be less than 35000, the number of suspended particles greater than 0.2 μm in per cubic meter to be less than 237000, the number of suspended particles greater than 0.2 μm in per cubic foot to be less than 7500, the number of suspended particles greater than 0.3 μm in per cubic meter to be less than 102000, the number of suspended particles greater than 0.3 μm in per cubic foot to be less than 3000, the number of suspended particles greater than 0.5 μm in per cubic meter to be less than 35200, the number of suspended particles greater than 0.5 μm in per cubic foot to be less than 1000, the number of suspended particles greater than 1 μm in per cubic meter to be less than 8320, the number of suspended particles greater than 1 μm in per cubic foot to be less than 236, the number of suspended particles greater than 5 μm in per cubic meter to be less than 293, or the number of suspended particles greater than 5 μm in per cubic foot to be less than 7 so as to reach the cleanliness of clean room ISO6.

The indoor air cleaning system of the present disclosure allows the gas state in the indoor field A to have the number of suspended particles greater than 0.5 μm in per cubic meter to be less than 352000, the number of suspended particles greater than 0.5 μm in per cubic foot to be less than 10000, the number of suspended particles greater than 1 μm in per cubic meter to be less than 83200, the number of suspended particles greater than 1 μm in per cubic foot to be less than 2360, the number of suspended particles greater than 5 μm in per cubic meter to be less than 2930, or the number of suspended particles greater than 5 μm in per cubic foot to be less than 70 so as to reach the cleanliness of clean room ISO7.

The indoor air cleaning system of the present disclosure allows the gas state in the indoor field A to have the number of suspended particles greater than 0.5 μm in per cubic meter to be less than 3520000, the number of suspended particles greater than 0.5 μm in per cubic foot to be less than 100000, the number of suspended particles greater than 1 μm in per cubic meter to be less than 832000, the number of suspended particles greater than 1 μm in per cubic foot to be less than 23600, the number of suspended particles greater than 5 μm in per cubic meter to be less than 29300, or the number of suspended particles greater than 5 μm in per cubic foot to be less than 700 so as to reach the cleanliness of clean room ISO8.

The indoor air cleaning system of the present disclosure allows the gas state in the indoor field A to have the number of suspended particles greater than 0.5 μm in per cubic meter to be less than 35200000, the number of suspended particles greater than 0.5 μm in per cubic foot to be less than 1000000, the number of suspended particles greater than 1 μm in per cubic meter to be less than 8320000, the number of suspended particles greater than 1 μm in per cubic foot to be less than 236000, the number of suspended particles greater than 5 μm in per cubic meter to be less than 293000, or the number of suspended particles greater than 5 μm in per cubic foot to be less than 7000 so as to reach the cleanliness of clean room ISO9.

In the present disclosure, the gas detector a of the indoor air cleaning system includes a gas detection module for the specific implementation, and the structure of the gas detection module of the gas detector a of the present disclosure is described in detail below. Please refer to FIG. 3A to FIG. 11. In the embodiment, the gas detection module includes a controlling circuit board 11, a gas detection main part 12, a microprocessor 13 and a communicator 14. The gas detection main part 12, the microprocessor 13 and the communicator 14 are integrally packaged on the controlling circuit board 11 and electrically connected to each other. In the embodiment, the microprocessor 13 and the communicator 14 are mounted on the controlling circuit board 11. The microprocessor 13 controls the driving signal of the gas detection main part 12 for enabling the detection. In this way, the gas detection main part 12 detects the air pollution and outputs the air pollution information, and the microprocessor 14 receives, processes and provides the air pollution information to the communicator 14 for a communication transmission externally, and transmitting to the cloud computing server device 4 through IoT (Internet of Things) communication.

Please refer to FIG. 4A to FIG. 9A. In the embodiment, the gas detection main part 12 includes a base 121, a piezoelectric actuator 122, a driving circuit board 123, a laser component 124, a particulate sensor 125, and an outer cover 126. In the embodiment, the base 121 includes a first surface 1211, a second surface 1212, a laser loading region 1213, a gas-inlet groove 1214, a gas-guiding-component loading region 1215 and a gas-outlet groove 1216. The first surface 1211 and the second surface 1212 are two surfaces opposite to each other. In the embodiment, the laser loading region 1213 is hollowed out from the first surface 1211 toward the second surface 1212. The outer cover 126 covers the base 121 and includes a side plate 1261. The side plate 1261 has an inlet opening 1261*a* and an outlet opening 1261*b*. The gas-inlet groove 1214 is concavely formed from the second surface 1212 and disposed adjacent to the laser loading region 1213. The gas-inlet groove 1214 includes a gas-inlet 1214*a* and two lateral walls. The gas-inlet 1214*a* is in communication with an environment outside the base 121, and is spatially corresponding in position to an inlet opening 1261*a* of the outer cover 126. Two transparent windows 1214*b* are opened on the two lateral walls of the gas-inlet groove 1214 and are in communication with the laser loading region 1213. Therefore, the first surface 1211 of the base 121 is covered and attached by the outer cover 126, and the second surface 1212 is covered and attached by the driving circuit board 123, so that an inlet path is defined by the gas-inlet groove 1214.

In the embodiment, the gas-guiding-component loading region 1215 mentioned above is concavely formed from the second surface 1212 and in communication with the gas-inlet groove 1214. A ventilation hole 1215*a* penetrates a bottom surface of the gas-guiding-component loading region 1215. The gas-guiding-component loading region 1215 includes four positioning protrusions 1215*b* disposed at four corners of the gas-guiding-component loading region 1215, respectively. In the embodiment, the gas-outlet groove 1216 includes a gas-outlet 1216*a*, and the gas-outlet 1216*a* is spatially corresponding to the outlet opening 1261*b* of the outer cover 126. The gas-outlet groove 1216 includes a first section 1216*b* and a second section 1216*c*. The first section 1216*b* is concavely formed out from the first surface 1211 in a region spatially corresponding to a vertical projection area of the gas-guiding-component loading region 1215. The second section 1216*c* is hollowed out from the first surface 1211 to the second surface 1212 in a region where the first surface 1211 is extended from the vertical projection area of the gas-guiding-component loading region 1215. The first section 1216*b* and the second section 1216*c* are connected to form a stepped structure. Moreover, the first section 1216*b* of the gas-outlet groove 1216 is in communication with the ventilation hole 1215*a* of the gas-guiding-component loading region 1215, and the second section 1216*c* of the gas-outlet groove 1216 is in communication with the gas-outlet 1216*a*. In that, when first surface 1211 of the base 121 is attached and covered by the outer cover 126 and the second surface 1212 of the base 121 is attached and covered by the driving circuit board 123, the gas-outlet groove 1216 and the driving circuit board 123 collaboratively define an outlet path.

In the embodiment, the laser component 124 and the particulate sensor 125 are disposed on and electrically connected to the driving circuit board 123 and located within the base 121. In order to clearly describe and illustrate the positions of the laser component 124 and the particulate sensor 125 in the base 121, the driving circuit board 123 is intentionally omitted. The laser component 124 is accommodated in the laser loading region 1213 of the base 121, and the particulate sensor 125 is accommodated in the gas-inlet groove 1214 of the base 121 and is aligned to the laser component 124. In addition, the laser component 124 is spatially corresponding to the transparent window 1214*b*, therefore, a light beam emitted by the laser component 124 passes through the transparent window 1214*b* and is irradiated into the gas-inlet groove 1214. A light beam path emitted from the laser component 124 passes through the transparent window 1214*b* and extends in an orthogonal direction perpendicular to the gas-inlet groove 1214. In the embodiment, a projecting light beam emitted from the laser component 124 passes through the transparent window 1214*b* and enters the gas-inlet groove 1214 to irradiate the suspended particles contained in the gas passing through the gas-inlet groove 1214. When the suspended particles contained in the gas are irradiated and generate scattered light spots, the scattered light spots are received and calculated by the particulate sensor 125 to obtain the gas detection information.

In the embodiment, the piezoelectric actuator 122 is accommodated in the square-shaped gas-guiding-component loading region 1215 of the base 121. In addition, the gas-guiding-component loading region 1215 of the base 121 is in fluid communication with the gas-inlet groove 1214. When the piezoelectric actuator 122 is enabled, the gas in the gas-inlet groove 1214 is inhaled by the piezoelectric actuator 122, so that the gas flows into the piezoelectric actuator 122, and is transported into the gas-outlet groove 1216 through the ventilation hole 1215*a* of the gas-guiding-component loading region 1215. Moreover, the driving circuit board 123 covers the second surface 1212 of the base 121, and the laser component 124 is disposed on the driving circuit board 123, and is electrically connected to the driving circuit board 123. The particulate sensor 125 is also disposed on the driving circuit board 123 and electrically connected to the driving circuit board 123. In that, when the outer cover 126 covers the base 121, the inlet opening 1261*a* is spatially corresponding to the gas-inlet 1214*a* of the base 121, and the outlet opening 1261*b* is spatially corresponding to the gas-outlet 1216*a* of the base 121.

In the embodiment, the piezoelectric actuator 122 includes a gas-injection plate 1221, a chamber frame 1222, an actuator element 1223, an insulation frame 1224 and a conductive frame 1225. In the embodiment, the gas-injection plate 1221 is made by a flexible material and includes a suspension plate 1221*a* and a hollow aperture 1221*b*. The suspension plate 1221*a* is a sheet structure and is permitted to undergo a bending deformation. Preferably but not exclusively, the shape and the size of the suspension plate 1221*a* are accommodated in the inner edge of the gas-guiding-component loading region 1215, but not limited thereto. The hollow aperture 1221*b* passes through a center of the suspension plate 1221*a*, so as to allow the gas to flow therethrough. Preferably but not exclusively, in the embodiment, the shape of the suspension plate 1221*a* is selected from the group consisting of a square, a circle, an ellipse, a triangle and a polygon, but not limited thereto.

In the embodiment, the chamber frame 1222 is carried and stacked on the gas-injection plate 1221. In addition, the shape of the chamber frame 1222 is corresponding to the gas-injection plate 1221. The actuator element 1223 is carried and stacked on the chamber frame 1222. A resonance chamber 1226 is collaboratively defined by the actuator element 1223, the chamber frame 1222 and the suspension plate 1221*a* and is formed between the actuator element 1223, the chamber frame 1222 and the suspension plate 1221*a*. The insulation frame 1224 is carried and stacked on the actuator element 1223 and the appearance of the insulation frame 1224 is similar to that of the chamber frame 1222. The conductive frame 1225 is carried and stacked on the insulation frame 1224, and the appearance of the conductive frame 1225 is similar to that of the insulation frame 1224. In addition, the conductive frame 1225 includes a conducting pin 1225*a* and a conducting electrode 1225*b*. The conducting pin 1225*a* is extended outwardly from an outer edge of the conductive frame 1225, and the conducting electrode 1225*b* is extended inwardly from an inner edge of the conductive frame 1225. Moreover, the actuator element 1223 further includes a piezoelectric carrying plate 1223*a*, an adjusting resonance plate 1223*b* and a piezoelectric plate 1223*c*. The piezoelectric carrying plate 1223*a* is carried and stacked on the chamber frame 1222. The adjusting resonance plate 1223*b* is carried and stacked on the piezoelectric carrying plate 1223*a*. The piezoelectric plate 1223*c* is carried and stacked on the adjusting resonance plate 1223*b*. The adjusting resonance plate 1223*b* and the piezoelectric plate 1223*c* are accommodated in the insulation frame 1224. The conducting electrode 1225*b* of the conductive frame 1225 is electrically connected to the piezoelectric plate 1223*c*. In the embodiment, the piezoelectric carrying plate 1223*a* and the adjusting resonance plate 1223*b* are made by a conductive material. The piezoelectric carrying plate 1223*a* includes a piezoelectric pin 1223*d*. The piezoelectric pin 1223*d* and the conducting pin 1225*a* are electrically connected to a driving circuit (not shown) of the driving circuit board 123, so as to receive a driving signal, such as a driving frequency and a driving voltage. Through this structure, a circuit is formed by the piezoelectric pin 1223*d*, the piezoelectric carrying plate 1223*a*, the adjusting resonance plate 1223*b*, the piezoelectric plate 1223*c*, the conducting electrode 1225*b*, the conductive frame 1225 and the conducting pin 1225*a* for transmitting the driving signal. Moreover, the insulation frame 1224 is insulated between the conductive frame 1225 and the actuator element 1223, so as to avoid the occurrence of a short circuit. Thereby, the driving signal is transmitted to the piezoelectric plate 1223*c*. After receiving the driving signal such as the driving frequency and the driving voltage, the piezoelectric plate 1223*c* deforms due to the piezoelectric effect, and the piezoelectric carrying plate 1223*a* and the adjusting resonance plate 1223*b* are further driven to generate the bending deformation in the reciprocating manner.

Furthermore, in the embodiment, the adjusting resonance plate 1223*b* is located between the piezoelectric plate 1223*c* and the piezoelectric carrying plate 1223*a* and served as a cushion between the piezoelectric plate 1223*c* and the piezoelectric carrying plate 1223*a*. Thereby, the vibration frequency of the piezoelectric carrying plate 1223*a* is adjustable. Basically, the thickness of the adjusting resonance plate 1223*b* is greater than the thickness of the piezoelectric carrying plate 1223*a*, and the vibration frequency of the actuator element 1223 can be adjusted by adjusting the thickness of the adjusting resonance plate 1223*b*.

Please further refer to FIG. 7A, FIG. 7B, FIG. 8A, FIG. 8B and FIG. 9A. In the embodiment, the gas-injection plate 1221, the chamber frame 1222, the actuator element 1223, the insulation frame 1224 and the conductive frame 1225 are stacked and positioned in the gas-guiding-component loading region 1215 sequentially, so that the piezoelectric actuator 122 is supported and positioned in the gas-guiding-component loading region 1215. A plurality of clearances 1221*c* are defined between the suspension plate 1221*a* of the gas-injection plate 1221 and an inner edge of the gas-guiding-component loading region 1215 for gas flowing therethrough. In the embodiment, a flowing chamber 1227 is formed between the gas-injection plate 1221 and the bottom surface of the gas-guiding-component loading region 1215. The flowing chamber 1227 is in communication with the resonance chamber 1226 between the actuator element 1223, the chamber frame 1222 and the suspension plate 1221*a* through the hollow aperture 1221*b* of the gas-injection plate 1221. By controlling the vibration frequency of the gas in the resonance chamber 1226 to be close to the vibration frequency of the suspension plate 1221*a*, the Helmholtz resonance effect is generated between the resonance chamber 1226 and the suspension plate 1221*a*, so as to improve the efficiency of gas transportation. When the piezoelectric plate 1223*c* is moved away from the bottom surface of the gas-guiding-component loading region 1215, the suspension plate 1221*a* of the gas-injection plate 1221 is driven to move away from the bottom surface of the gas-guiding-component loading region 1215 by the piezoelectric plate 1223*c*. In that, the volume of the flowing chamber 1227 is expanded rapidly, the internal pressure of the flowing chamber 1227 is decreased to form a negative pressure, and the gas outside the piezoelectric actuator 122 is inhaled through the clearances 1221*c* and enters the resonance chamber 1226 through the hollow aperture 1221*b*. Consequently, the pressure in the resonance chamber 1226 is increased to generate a pressure gradient. When the suspension plate 1221*a* of the gas-injection plate 1221 is driven by the piezoelectric plate 1223*c* to move toward the bottom surface of the gas-guiding-component loading region 1215, the gas in the resonance chamber 1226 is discharged out rapidly through the hollow aperture 1221*b*, and the gas in the flowing chamber 1227 is compressed, thereby the converged gas is quickly and massively ejected out of the flowing chamber 1227 under the condition close to an ideal gas state of the Benulli's law, and transported to the ventilation hole 1215*a* of the gas-guiding-component loading region 1215.

Figure 9A:
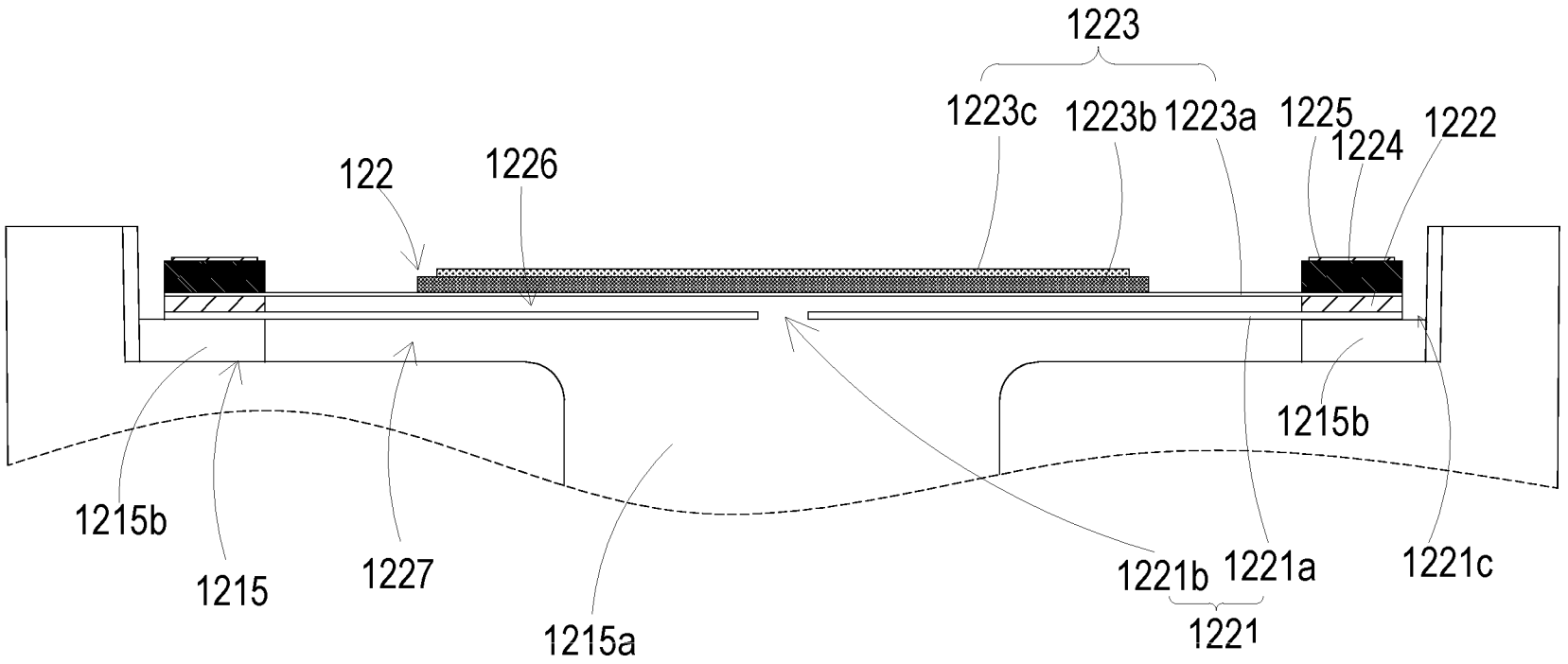
FIG. 9A is a schematic cross-sectional view (1) illustrating an action of the piezoelectric actuator according to the embodiment of the present disclosure.
Figure 9B:
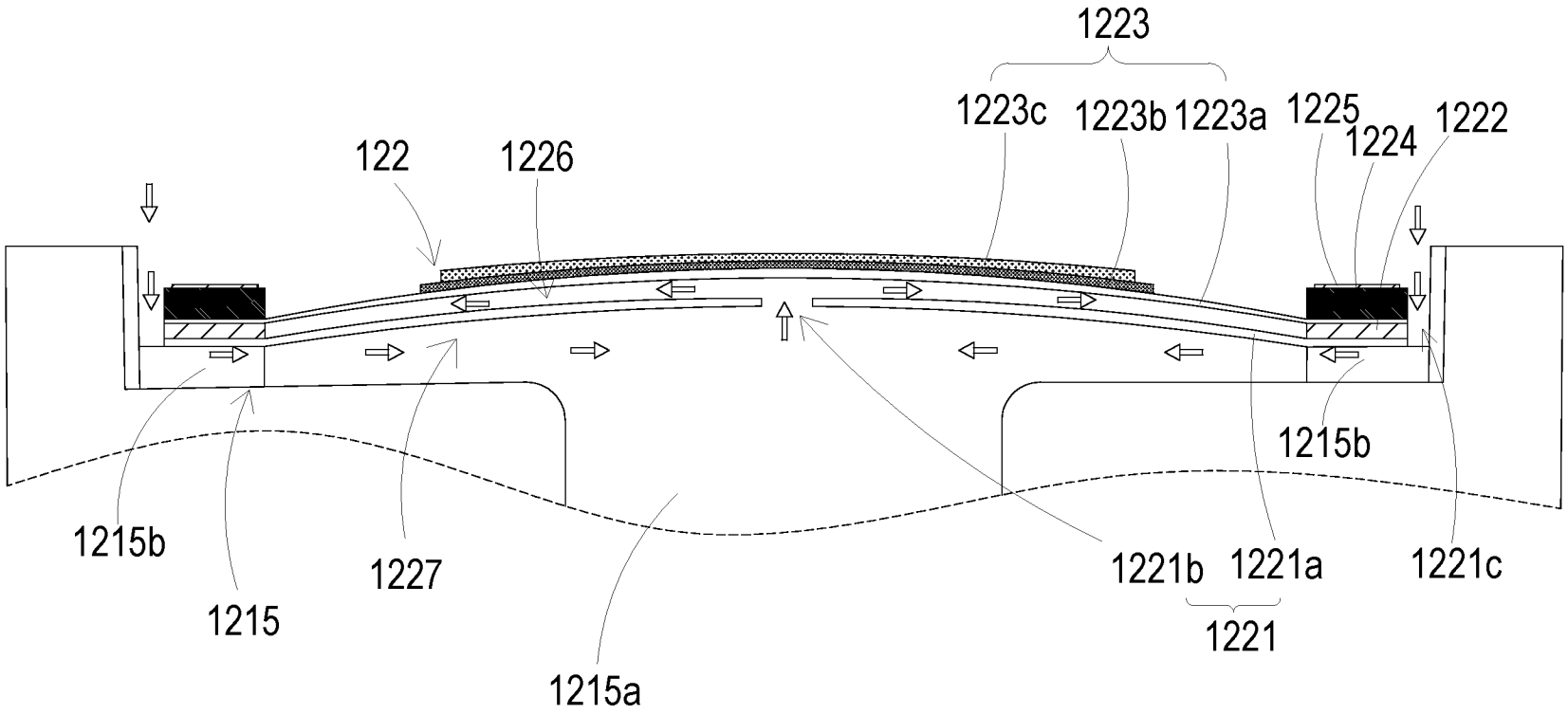
FIG. 9B is a schematic cross-sectional view (2) illustrating an action of the piezoelectric actuator according to the embodiment of the present disclosure.
Figure 9C:
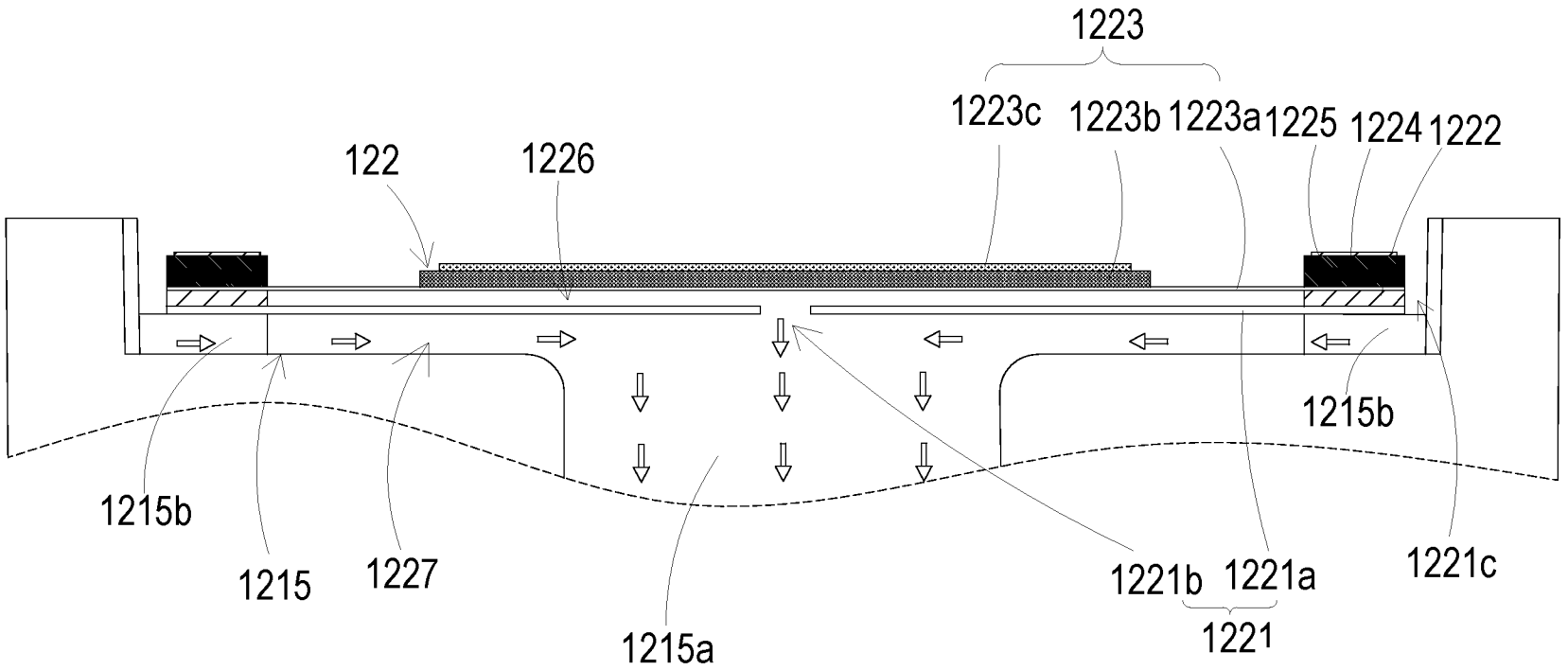
FIG. 9C is a schematic cross-sectional view (3) illustrating an action of the piezoelectric actuator according to the embodiment of the present disclosure.
Figure 10A:
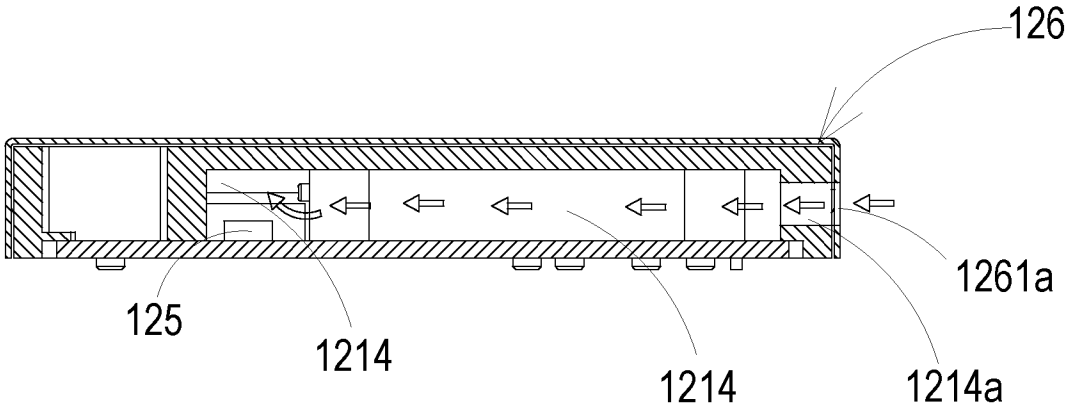
FIG. 10A is a schematic cross-sectional view (1) illustrating the gas detection main part according to the embodiment of the present disclosure.
Figure 10B:
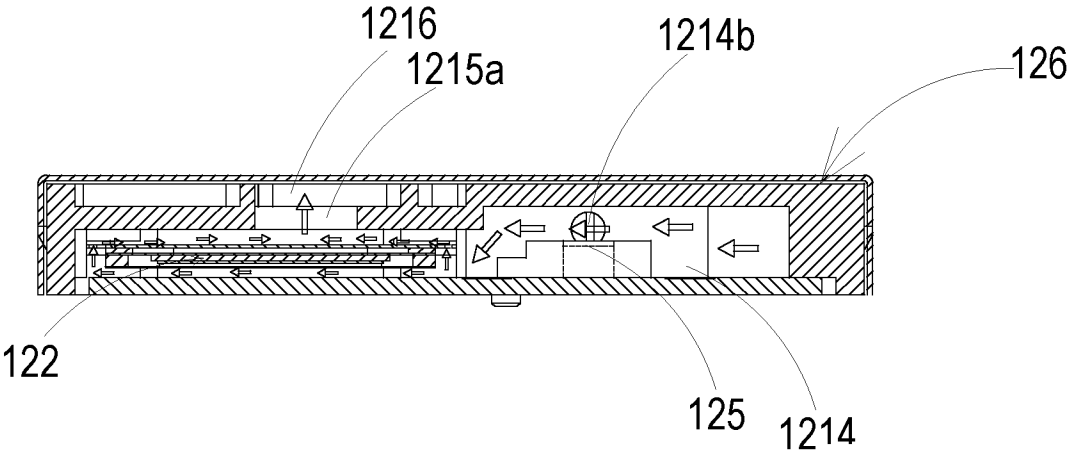
FIG. 10B is a schematic cross-sectional view (2) illustrating the gas detection main part according to the embodiment of the present disclosure.
Figure 10C:
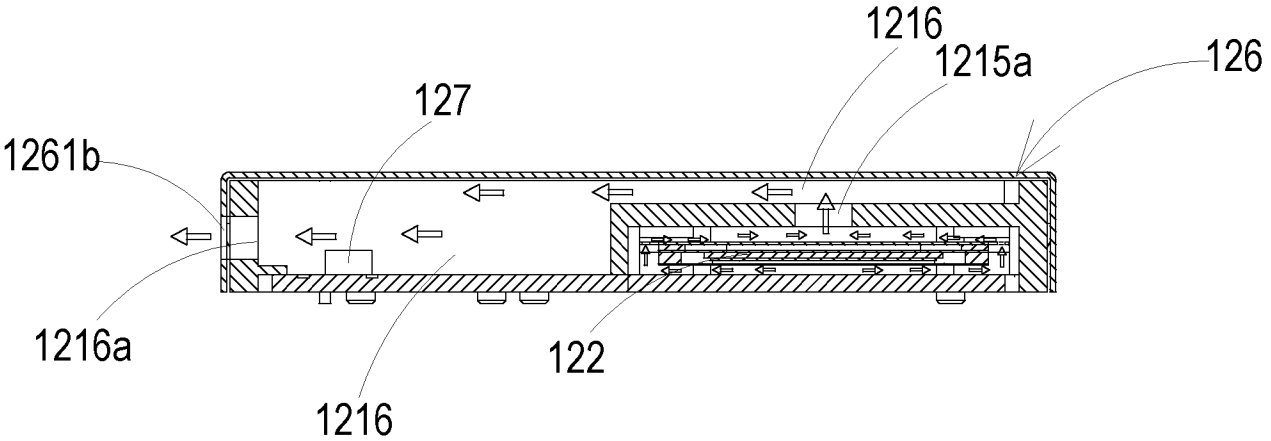
FIG. 10C is a schematic cross-sectional view (3) illustrating the gas detection main part according to the embodiment of the present disclosure.
Figure 11:
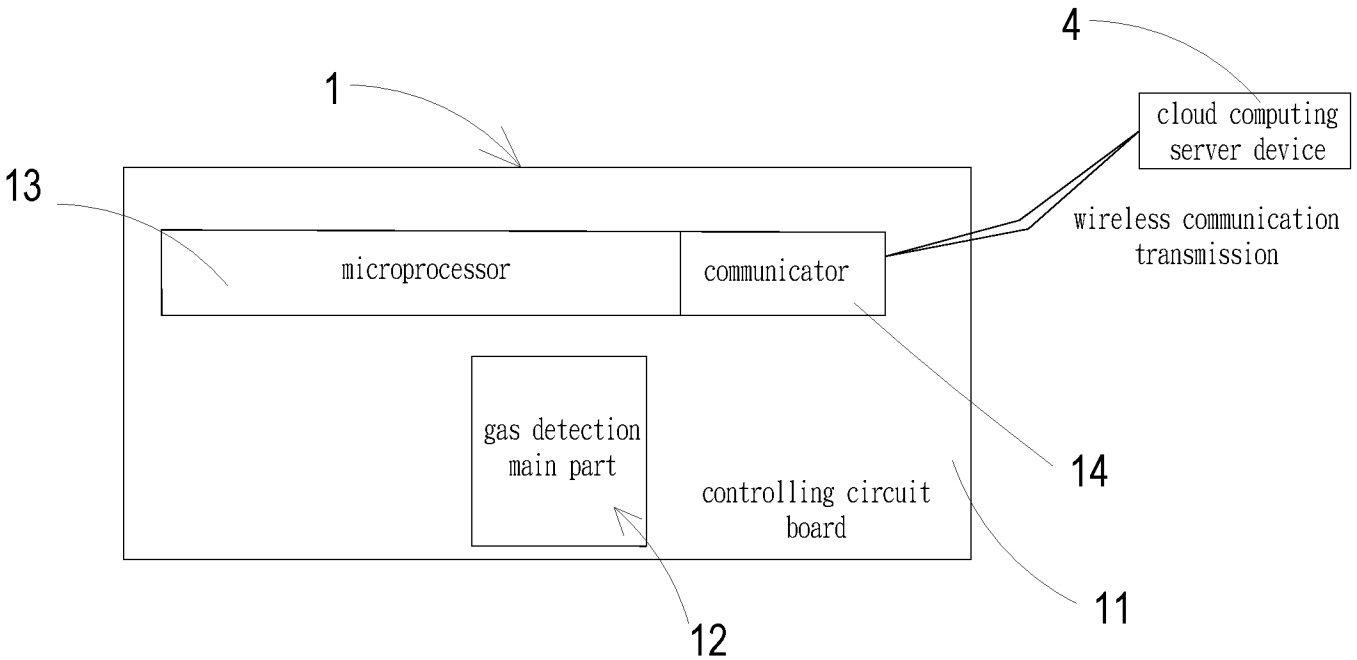
FIG. 11 is a schematic diagram illustrating the communication transmission of the gas detector according to the embodiment of the present invention.

By repeating the above operation steps shown in FIG. 9B and FIG. 9C, the piezoelectric plate 1223*c* is driven to generate the bending deformation in a reciprocating manner. According to the principle of inertia, since the gas pressure inside the resonance chamber 1226 is lower than the equilibrium gas pressure after the converged gas is ejected out, the gas is introduced into the resonance chamber 1226 again. Moreover, the vibration frequency of the gas in the resonance chamber 1226 is controlled to be close to the vibration frequency of the piezoelectric plate 1223*c*, so as to generate the Helmholtz resonance effect to achieve the gas transportation at high speed and in large quantities. The gas is inhaled through the gas-inlet 1214*a* on the outer cover 126, flows into the gas-inlet groove 1214 of the base 121 through the gas-inlet 1214*a*, and is transported to the position of the particulate sensor 125. The piezoelectric actuator 122 is enabled continuously to inhale the gas into the inlet path, and facilitate the gas outside the gas detection module to be introduced rapidly, flow stably, and transported above the particulate sensor 125. At this time, a projecting light beam emitted from the laser component 124 passes through the transparent window 1214*b* to irritate the suspended particles contained in the gas flowing above the particulate sensor 125 in the gas-inlet groove 1214. When the suspended particles contained in the gas are irradiated and generate scattered light spots, the scattered light spots are received and calculated by the particulate sensor 125 for obtaining related information about the sizes and the concentration of the suspended particles contained in the gas. Moreover, the gas above the particulate sensor 125 is continuously driven and transported by the piezoelectric actuator 122, flows into the ventilation hole 1215*a* of the gas-guiding-component loading region 1215, and is transported to the gas-outlet groove 1216. At last, after the gas flows into the gas outlet groove 1216, the gas is continuously transported into the gas-outlet groove 1216 by the piezoelectric actuator 122, and thus the gas in the gas-outlet groove 1216 is pushed to discharge through the gas-outlet 1216*a* and the outlet opening 1261*b*.

The gas detector 1 of the present disclosure not only can detect the particulate matters in the gas, but also can detect the gas characteristics of the introduced gas, for example, to determine whether the gas is formaldehyde, ammonia, carbon monoxide, carbon dioxide, oxygen, ozone, or the like. Therefore, in one or some embodiments, the gas detector 1 of the present disclosure further includes a gas sensor 127 positioned and disposed on the driving circuit board 123, electrically connected to the driving circuit board 123, and accommodated in the gas-outlet groove 1216, so as to detect the air pollution introduced into the gas-outlet groove 1216. Preferably but not exclusively, in an embodiment, the gas sensor 127 includes a volatile-organic-compound sensor for detecting the information of carbon dioxide ($CO_2$) or volatile organic compounds (TVOC). Preferably but not exclusively, in an embodiment, the gas sensor 127 includes a formaldehyde sensor for detecting the information of formaldehyde (HCHO) gas. Preferably but not exclusively, in an embodiment, the gas sensor 127 includes a bacteria sensor for detecting the information of bacteria or fungi. Preferably but not exclusively, in an embodiment, the gas sensor 127 includes a virus sensor for detecting the information of virus in the gas. Preferably but not exclusively, the gas sensor 127 is a temperature and humidity sensor for detecting the temperature and humidity information of the gas.

Figure 2A:
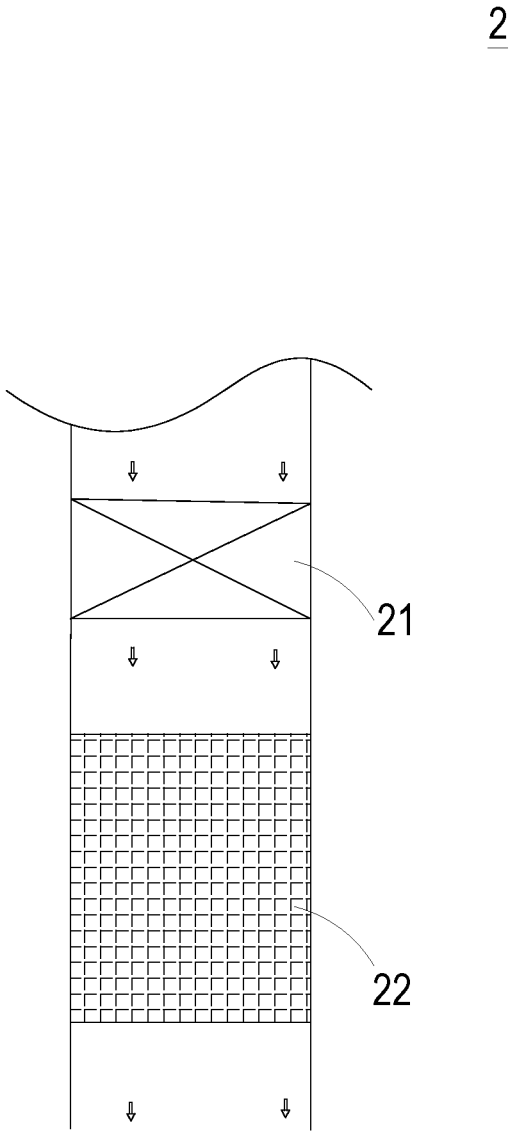
FIG. 2A is a schematic view illustrating the combination of the fan and the filter element of the circulation filter device according to the embodiment of the present disclosure.
Figure 2B:
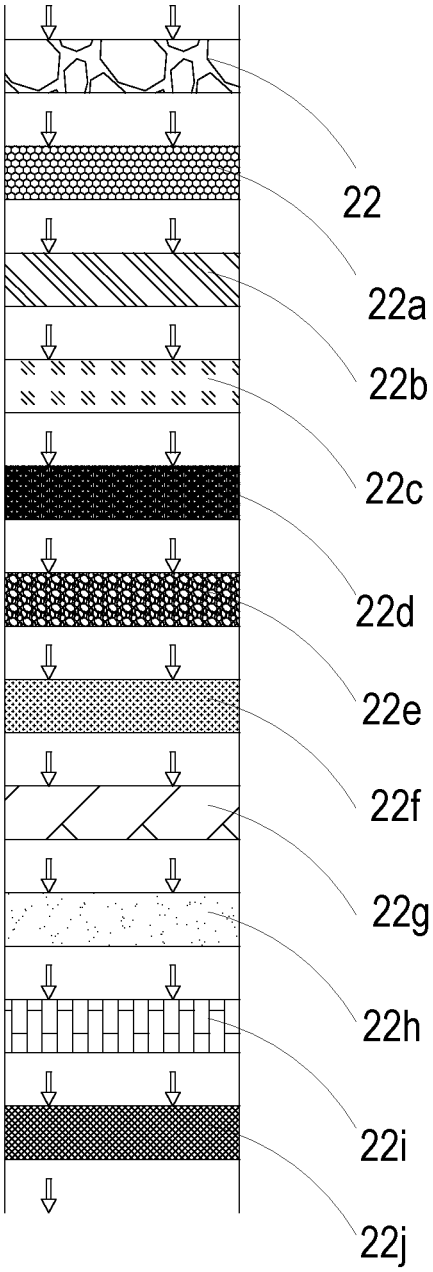
FIG. 2B is a schematic view illustrating the combination of the filter element of the circulation filter device according to the embodiment of the present disclosure.

Please refer to FIG. 2A and FIG. 2B. In the embodiment, the circulation filter device 2 includes a fan 21 and a filter element 22. The fan 21 is controlled and enabled to guide the air pollution to pass through the filter element 22 for filtration. Preferably but not exclusively, in an embodiment, the filter element 22 includes a high efficiency particulate air (HEPA) filter screen, which is configured to absorb the chemical smoke, the bacteria, the dust particles and the pollen contained in the air pollution, so that the air pollution introduced into the filter element 22 is filtered and purified to achieve the effect of filtering and purification. As shown in FIG. 2A, the filter element 22 of the present disclosure is further combined with physical or chemical materials to provide a sterilization effect on the air pollution, and the airflow of the fan 21 flows in the path indicated by the arrow. As shown in FIG. 2B, in the embodiment, the filter element 22 includes a decomposition layer coated thereon to sterilize in chemical means. Preferably but not exclusively, the decomposition layer includes an activated carbon 22*a* configured to remove organic and inorganic substances in air pollution, and remove colored and odorous substances. Preferably but not exclusively, the decomposition layer includes a cleansing factor containing chlorine dioxide layer 22*b* configured to inhibit viruses, bacteria, fungi, influenza A, influenza B, enterovirus and norovirus in the air pollution, and the inhibition ratio can reach 99% and more, thereby reducing the cross-infection of viruses. Preferably but not exclusively, the decomposition layer includes an herbal protective layer 22*c* extracted from ginkgo and Japanese *Rhus chinensis* configured to resist allergy effectively and destroy a surface protein of influenza virus (such as H1N1 influenza virus) passing therethrough. Preferably but not exclusively, the decomposition layer includes a silver ion 22*d* configured to inhibit viruses, bacteria and fungi contained in the air pollution. Preferably but not exclusively, the decomposition layer includes a zeolite 23*e* configured to remove ammonia nitrogen, heavy metals, organic pollutants, *Escherichia coli*, phenol, chloroform and anionic surfactants. Furthermore, in some embodiments, the filter element 22 is combined with a light irradiation element to sterilize in chemical means. Preferably but not exclusively, the light irradiation element is a photo-catalyst unit including a photo catalyst 22*f* and an ultraviolet lamp 22*g*. When the photo catalyst 22*f* is irradiated by the ultraviolet lamp 22*g*, the light energy is converted into the chemical energy, thereby decomposes harmful gases and disinfects bacteria contained in the air pollution, so as to achieve the effects of filtering and purifying. Preferably but not exclusively, the light irradiation element is a photo-plasma unit including a nanometer irradiation tube 22*h*. When the introduced air pollution is irradiated by the nanometer irradiation tube 22*h*, the oxygen molecules and water molecules contained in the air pollution are decomposed into high oxidizing photo-plasma, and an ion flow capable of destroying organic molecules is generated. In that, volatile formaldehyde, volatile toluene and volatile organic compounds (VOC) contained in the air pollution are decomposed into water and carbon dioxide, so as to achieve the effects of filtering and purifying. Moreover, in some embodiments, the filter element 22 is combined with a decomposition unit to sterilize in chemical means. Preferably but not exclusively, the decomposition unit is a negative ion unit 22*i* with a dust collecting plate. It makes the suspended particles in the air pollution to carry with positive charge and adhered to the dust collecting plate carry with negative charges, so as to achieve the effects of filtering and purifying. Preferably but not exclusively, the decomposition unit is a plasma ion unit 22*j*. The oxygen molecules and water molecules contained in the air pollution are decomposed into positive hydrogen ions ($H^+$) and negative oxygen ions ($O^{2-}$) by the plasma ion. The substances attached with water around the ions are adhered on the surface of viruses and bacteria and converted into OH radicals with extremely strong oxidizing power, thereby removing hydrogen (H) from the protein on the surface of viruses and bacteria, and thus decomposing (oxidizing) the protein, so as to filter the introduced air pollution and achieve the effects of filtering and purifying.

Figure 12:
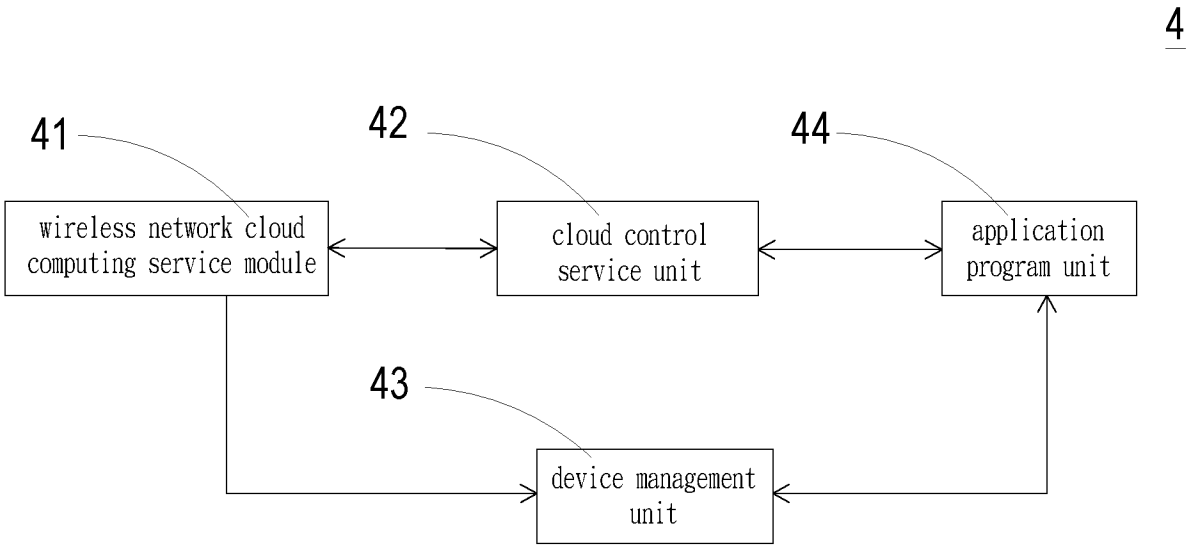
FIG. 12 is a schematic diagram of the architecture of the cloud computing server device according to the embodiment of the present disclosure.

Please refer to FIG. 12. In the embodiment, the cloud computing server device 4 includes a wireless network cloud computing service module 41, a cloud control service unit 42, a device management unit 43 and an application program unit 44. The wireless network cloud computing service module 41 receives the air pollution information of the outdoor field B, receives the air pollution information of the indoor field A, receives the communication information of the devices (such as the circulation filter device 2, the air conditioning device 3 and the gas exchange device 5) and transmits the control commands. Moreover, the wireless network cloud computing service module 41 receives the air pollution information of the indoor field A and the outdoor field B and transmits it to the cloud control service unit 42 to store and form an air pollution database. An artificial intelligence calculation is implemented to determine the location of the air pollution through the air pollution database comparison, so that the control command is transmitted to the wireless network cloud computing service module 41, and then transmitted to the devices (such as the circulation filter device 2, the air conditioning device 3 and the gas exchange device 5) to control the actuation operation through the wireless network cloud computing service module 41. The device management unit 43 receives the communication information of the devices through the wireless network cloud computing service module 41 to manage the user login and device binding. The device management information can be provided to the application program unit 44 for system control and management, and the application program unit 44 can also display and inform the air pollution information obtained by the cloud control service unit 42. The user can know the real-time status of air pollution removal through the mobile phone or the communication device. Moreover, the user can control the operation of the indoor air cleaning system through the application program unit 44 of the mobile phone or the communication device.

In addition, since the conventional clean rooms used in the industrial environments do not have sensors for real-time detection of air pollution around the clock, the cleaning devices need to be operated at high speed 24 hours a day. This operation method will cause a lot of energy loss and high noise environment, the conventional clean room system used in the industrial environments cannot be used in ordinary indoor home life. Furthermore, the conventional clean room equipment used in industrial environments needs to roughly filter suspended particles and control the temperature and humidity of the clean room through the external air conditioning box. After that, the circulating air volume is mixed with the supplementary air volume of the external air conditioning box through the back-flow air duct, and then passes through the cooling plate to cool the back-flow air between the back-flow air ducts, so as to meet the specifications required of the clean room. Such equipment is expensive to set up, the producing project is huge, and it consumes a lot of electricity. Therefore, the present disclosure provides an indoor air cleaning system By disposing a plurality of gas detectors in the indoor field and the outdoor field, disposing at least one circulation back-flow channel and at least one air conditioning device in the indoor field, and disposing at least one circulation filter device and at least one gas exchange device in the circulation back-flow channel, the gas detectors can monitor and determine the air pollution in the indoor field and the outdoor field at any time, and output an air pollution information. Then the cloud computing server device receives the air pollution information, stores the air pollution information to an air pollution database, receives the temperature and humidity information of the output gas from the air conditioning device, implements artificial intelligence calculation based on the air pollution database and the temperature and humidity information, and issues the control command to a plurality of the circulation filter devices, and timely adjusts and controls the fan of the circulation filter device for actuation, so as to randomly change and adjust the airflow volume and the actuation time period based on the cleanliness of the number of particles in real time. Whereby the cleaning efficiency of the indoor field is improved, the environmental noise of the indoor field is reduced, the internal circulation directional airflow is generated in the indoor field to generate, and the air pollution is guided to pass through the filter element multiple times for filtration, so that the gas state in the indoor field has the number of suspended particles with the particle size greater than 0.1 μm in per cubic meter/per cubic foot to reach a cleanliness of clean room ISO1~9. If the indoor air cleaning system of the present disclosure is applied to the industrial environment field, it allows to achieve the requirements of clean room ISO1~9, and obtain a control within a certain demand range to meet the required process production and a relatively clean operating environment. Certainly, the indoor air cleaning system the present disclosure is applicable to the industrial environment field, such as the semiconductor production, the biochemical technology, the biotechnology, the precision machinery and the pharmaceuticals. As shown in FIG. 1B, the indoor field A is further equipped with at least one dust-free aseptic operation cabinet 6*a*, at least one automatic hand washing and drying machine 6*b*, at least one biological safety operation cabinet 6*c*, at least air bath dust room 6*d*, at least one chemical fume exhaust cabinet 6*e* or at least one transfer box 6*f* for clean room operations.

In summary, the present disclosure provides an indoor air cleaning system. By disposing a plurality of gas detectors in the indoor field and the outdoor field, disposing at least one circulation back-flow channel and at least one air conditioning device in the indoor field, and disposing at least one circulation filter device and at least one gas exchange device in the circulation back-flow channel, the gas detectors can monitor and determine the air pollution in the indoor field and the outdoor field at any time, and output an air pollution information. Then the cloud computing server device receives the air pollution information, stores the air pollution information to an air pollution database, receives the temperature and humidity information of the output gas from the air conditioning device, implements artificial intelligence calculation based on the air pollution database and the temperature and humidity information, and issues the control command to a plurality of the circulation filter devices, and timely adjusts and controls the fan of the circulation filter device for actuation, so as to randomly change and adjust the airflow volume and the actuation time period based on the cleanliness of the number of particles in real time. Whereby the cleaning efficiency of the indoor field is improved, the environmental noise of the indoor field is reduced, the internal circulation directional airflow is generated in the indoor field to generate, and the air pollution is guided to pass through the filter element multiple times for filtration, so that the gas state in the indoor field has the number of suspended particles with the particle size greater than 0.1 μm in per cubic meter/per cubic foot to reach a cleanliness of clean room ISO1~9. It makes the indoor field to meet the requirements of a clean room and avoids being exposed to hazardous gas in the environment that may cause the human health impacts and injuries. The present disclosure includes the industrial applicability and the inventive steps.

What is claimed is:

1. An indoor air cleaning system, comprising:

a plurality of gas detectors disposed in an indoor field and an outdoor field for detecting air pollution information, wherein the plurality of gas detectors output the air pollution information through IoT communication;

at least one circulation back-flow channel surrounded and isolated by several partitions to form on a side of the indoor field, and comprising a plurality of air intakes and a plurality of back-flow vents;

a plurality of circulation filter devices disposed in the at least one circulation back-flow channel and corresponding to the plurality of air intakes, wherein each of the plurality of circulation filter devices comprises a fan, a filter element, a gas detector and a driving control element, one gas detector of the plurality of circulation filter devices receives a control command through IoT communication to the corresponding driving control element of the plurality of circulation filter devices to control and actuate an operation of the fan, and the corresponding fan is controlled and actuated to guide air pollution for filtering through the corresponding filter element and discharging through the plurality of air intakes into the indoor field;

at least one air conditioning device disposed in the indoor field for temperature and humidity adjustment, and comprising a gas detector and a driving control element, wherein one gas detector of the at least one air conditioning device receives a second control command through IoT communication to the corresponding driving control element of the at least one air conditioning device to control and actuate an operation of the at least one air conditioning device, and externally transmit air temperature and humidity information of the indoor field; and a cloud computing server device receiving the air pollution information of the indoor field and the outdoor field through IoT communication for storing to form a database of the air pollution information, the cloud computing server device also receiving the temperature and humidity information outputted from the air conditioning device, comparing the database of the air pollution information and the temperature and humidity information by intelligent computing and intelligently selecting according to the database of the air pollution information and the temperature and humidity information to output the control command to the corresponding fan of the plurality of circulation filter devices for actuation operation, whereby the corresponding fan of the plurality of circulation filter devices generates an internal circulation directional airflow continuously, and the air pollution is guided to pass through the corresponding filter element multiple times for filtration, therefore gas state in the indoor field has a number of suspended particles greater than 0.1 μm in per cubic meter/per cubic foot to be less than that of a cleanliness specification and reach a cleanliness of clean room ISO 1~9.

2. The indoor air cleaning system according to claim 1, wherein the air pollution is at least one selected from the group consisting of particulate matter, carbon monoxide, carbon dioxide, ozone, sulfur dioxide, nitrogen dioxide, lead, total volatile organic compounds (TVOC), formaldehyde, bacteria, fungi, virus and a combination thereof, wherein the intelligently computing comprises artificial intelligence (AI) computing or/and edge computing.

3. The indoor air cleaning system according to claim 1, further comprising at least one gas exchange device disposed in the indoor field, wherein the at least one gas exchange device is disposed in the at least one circulation back-flow channel, corresponds to the plurality of air intakes, and communicates with the outdoor field through an air intake channel, wherein the gas exchange device comprises a gas detector and a driving control element, wherein one gas detectors of the at least one gas exchange device is connected to and communicates with the cloud computing server device through IoT communication, wherein IoT communication is a wired communication or a wireless communication for connecting and communicating with the cloud computing server device through a wired communication transmission and a wireless communication transmission, wherein the wireless communication transmission is one selected from the group consisting of a Wi-Fi communication transmission, a Bluetooth communication transmission, a radio frequency identification communication transmission and a near field communication (NFC) transmission, wherein the gas detector of the at least one gas exchange device comprises a controlling circuit board, a gas detection main part, a microprocessor and a communicator, the controlling circuit board is electrically connected to the corresponding driving control element of the plurality of circulation filter devices, and the corresponding gas detection main part, the microprocessor and the communicator are integrally packaged on the corresponding controlling circuit board and electrically connected to the corresponding controlling circuit board, wherein the microprocessor controls the detection of the corresponding gas detection main part, the gas detection main part detects the air pollution and outputs a detection signal, and the microprocessor receives and processes the detection signal to generate the air pollution information and provides the air pollution information to the corresponding communicator for a communication transmission externally.

4. The indoor air cleaning system according to claim 3, wherein the cloud computing server device intelligently compares the air pollution information of the indoor field and the outdoor field, when the air pollution information of the indoor field is higher than the air pollution information of the outdoor field, the cloud computing server device issues the control command to the gas detector of the at least one gas exchange device through IoT communication, and the control command is received to the corresponding driving control element of the at least one gas exchange device to control an actuation operation of the corresponding gas exchange device, so that gas from the outdoor field is introduced into the indoor field for ventilation, wherein the air pollution information of the indoor field and the outdoor field is carbon dioxide ($CO_2$) air pollution data less than 800 PPM.

5. The indoor air cleaning system according to claim 4, wherein another control command is issued directly to the driving control element of the at least one gas exchange device to control an actuation operation of the corresponding gas exchange device when the gas detector of the at least one gas exchange device detects that the air pollution information of the indoor field exceeds a pollution threshold safety value, thereby gas from the outdoor field is introduced into the indoor field for ventilation, wherein the pollution threshold safety value is carbon dioxide ($CO_2$) air pollution data less than 800 PPM.

6. The indoor air cleaning system according to claim 3, wherein the at least one gas exchange device further comprising a valve disposed between the air intake channel in communication with the at least one gas exchange device and the outdoor field, and controlled by the driving control element of the at least one gas exchange device, wherein the gas detector of the at least one gas exchange device generates a control command and transmits the control command to the corresponding driving control element of the gas exchange device for controlling an actuation operation of the corresponding gas exchange device and controlling the opening of the valve simultaneously, so that the air intake channel is in communication with gas in the outdoor field, and the gas from the outdoor field is introduced into the indoor field for ventilation, wherein the corresponding gas exchange device is a fresh fan.

7. The indoor air cleaning system according to claim 1, wherein the plurality of gas detectors are connected to and communicates with the cloud computing server device through IoT communication, and IoT communication is a wired communication for connecting and communicating with the cloud computing server device through a wired communication transmission.

8. The indoor air cleaning system according to claim 1, wherein the plurality of gas detectors are connected to and communicates with the cloud computing server device through IoT communication, and IoT communication is a wireless communication for connecting and communicating with the cloud computing server device through a wireless communication transmission, wherein the wireless communication transmission is one selected from the group consisting of a Wi-Fi communication transmission, a Bluetooth communication transmission, a radio frequency identification communication transmission and a near field communication (NFC) transmission.

9. The indoor air cleaning system according to claim 1, wherein each of the gas detectors comprises a controlling circuit board, a gas detection main part, a microprocessor and a communicator, each of the controlling circuit boards are electrically connected to each of the driving control elements, and the gas detection main part, the microprocessor and the communicator are integrally packaged on the controlling circuit board and electrically connected to the controlling circuit board, wherein the microprocessor controls the detection of the gas detection main part, the gas detection main part detects the air pollution and outputs a detection signal, and the microprocessor receives and processes the detection signal to generate the air pollution information and provides the air pollution information to the communicator for a communication transmission externally.

10. The indoor air cleaning system according to claim 1, wherein the filter element comprises a decomposition layer coated thereon, and the decomposition layer uses chemical means to sterilize the air pollution, wherein the filter element is one selected from the group consisting of an ultra low particulate air (ULPA) filter, a high efficiency particulate air (HEPA) filter and a combination thereof.

11. The indoor air cleaning system according to claim 10, wherein the decomposition layer comprises at least one selected from the group consisting of an activated carbon, a cleansing factor containing chlorine dioxide layer, an herbal protective layer extracted from ginkgo and Japanese *Rhus chinensis*, a silver ion, a zeolite and a combination thereof.

12. The indoor air cleaning system according to claim 1, wherein the filter element is combined with one selected from the group consisting of a light irradiation element, a decomposition unit and a combination thereof to sterilize the air pollution in chemical means.

13. The indoor air cleaning system according to claim 12, wherein the light irradiation element is at least one selected from the group consisting of a photo-catalyst unit comprising a photo catalyst and an ultraviolet lamp, a photo-plasma unit comprising a nanometer irradiation tube and a combination thereof.

14. The indoor air cleaning system according to claim 12, wherein the decomposition unit is at least one selected from the group consisting of a negative ion unit, a plasma ion unit and a combination thereof.

15. The indoor air cleaning system according to claim 1, wherein the cloud computing server device comprises a wireless network cloud computing service module, a cloud control service unit, a device management unit and an application program unit.

16. The indoor air cleaning system according to claim 1, wherein the cloud computing server device intelligently computes the cleanliness according to the number of particles passing through the indoor field in real time, intelligently selects and issues the control command to transmit to a plurality of the circulation filter devices, and timely adjusts and controls the fan of the circulation filter device for actuation, so as to randomly change and adjust the airflow volume and the actuation time period based on the cleanliness of the number of particles in real time, whereby the cleaning efficiency of the indoor field is improved, the environmental noise of the indoor field is reduced, the internal circulation directional airflow is generated in the indoor field, and the air pollution is guided to pass through the filter element multiple times for filtration, so that the gas state in the indoor field has the number of suspended particles greater than 0.1 μm in per cubic meter/per cubic foot to be less than that of the cleanliness specification and reach the cleanliness of clean room ISO 1~9.

17. The indoor air cleaning system according to claim 1, wherein the cloud computing server device intelligently computes the cleanliness according to the number of suspended particles passing through the indoor field in real time, intelligently selects and issues the control command to transmit to a plurality of the circulation filter devices, and timely adjusts and controls the fan of the circulation filter device for actuation, so as to randomly change and adjust the airflow volume and the actuation time period based on the cleanliness of the number of suspended particles in real time, whereby the cleaning efficiency of the indoor field is improved, the environmental noise of the indoor field is reduced, the internal circulation directional airflow is generated in the indoor field, and the air pollution is guided to pass through the filter element multiple times for filtration, so that the gas state in the indoor field has the number of suspended particles greater than 0.1 μm in per cubic meter/per cubic foot to be less than that of the cleanliness specification and reach the cleanliness of clean room ISO 1~9.

18. The indoor air cleaning system according to claim 1, wherein the gas state in the indoor field has one selected from the group consisting of:

(1) the number of suspended particles greater than 0.1 μm in per cubic meter to be less than 10, or the number of suspended particles greater than 0.2 μm in per cubic meter to be less than 2, so as to reach the cleanliness of clean room ISO1;

(2) the number of suspended particles greater than 0.1 μm in per cubic meter to be less than 100, the number of suspended particles greater than 0.2 μm in per cubic meter to be less than 24, the number of suspended particles greater than 0.3 μm in per cubic meter to be less than 10, or the number of suspended particles greater than 0.5 μm in per cubic meter to be less than 4, so as to reach the cleanliness of clean room ISO2; and (3) the number of suspended particles greater than 0.1 μm in per cubic meter to be less than 1000, the number of suspended particles greater than 0.1 μm in per cubic foot to be less than 35, the number of suspended particles greater than 0.2 μm in per cubic meter to be less than 237, the number of suspended particles greater than 0.2 μm in per cubic foot to be less than 8, the number of suspended particles greater than 0.3 μm in per cubic meter to be less than 102, the number of suspended particles greater than 0.3 μm in per cubic foot to be less than 3, the number of suspended particles greater than 0.5 μm in per cubic meter to be less than 35, the number of suspended particles greater than 0.5 μm in per cubic foot to be less than 1, or the number of suspended particles greater than 1 μm in per cubic meter to be less than 8, so as to reach the cleanliness of clean room ISO3.

19. The indoor air cleaning system according to claim 1, wherein the gas state in the indoor field has one selected from the group consisting of:

(1) the number of suspended particles greater than 0.1 μm in per cubic meter to be less than 10000, the number of suspended particles greater than 0.1 μm in per cubic foot to be less than 350, the number of suspended particles greater than 0.2 μm in per cubic meter to be less than 2370, the number of suspended particles greater than 0.2 μm in per cubic foot to be less than 75, the number of suspended particles greater than 0.3 μm in per cubic meter to be less than 1020, the number of suspended particles greater than 0.3 μm in per cubic foot to be less than 30, the number of suspended particles greater than 0.5 μm in per cubic meter to be less than 352, the number of suspended particles greater than 0.5 μm in per cubic foot to be less than 10, the number of suspended particles greater than 1 μm in per cubic meter to be less than 83, or the number of suspended particles greater than 1 μm in per cubic foot to be less than 2, so as to reach the cleanliness of clean room ISO4;

(2) the number of suspended particles greater than 0.1 μm in per cubic meter to be less than 100000, the number of suspended particles greater than 0.1 μm in per cubic foot to be less than 3500, the number of suspended particles greater than 0.2 μm in per cubic meter to be less than 23700, the number of suspended particles greater than 0.2 μm in per cubic foot to be less than 750, the number of suspended particles greater than 0.3 μm in per cubic meter to be less than 10200, the number of suspended particles greater than 0.3 μm in per cubic foot to be less than 300, the number of suspended particles greater than 0.5 μm in per cubic meter to be less than 3520, the number of suspended particles greater than 0.5 μm in per cubic foot to be less than 100, the number of suspended particles greater than 1 μm in per cubic meter to be less than 832, the number of suspended particles greater than 1 μm in per cubic foot to be less than 24, or the number of suspended particles greater than 5 μm in per cubic meter to be less than 29, so as to reach the cleanliness of clean room ISO5; and (3) the number of suspended particles greater than 0.1 μm in per cubic meter to be less than 1000000, the number of suspended particles greater than 0.1 μm in per cubic foot to be less than 35000, the number of suspended particles greater than 0.2 μm in per cubic meter to be less than 237000, the number of suspended particles greater than 0.2 μm in per cubic foot to be less than 7500, the number of suspended particles greater than 0.3 μm in per cubic meter to be less than 102000, the number of suspended particles greater than 0.3 μm in per cubic foot to be less than 3000, the number of suspended particles greater than 0.5 μm in per cubic meter to be less than 35200, the number of suspended particles greater than 0.5 μm in per cubic foot to be less than 1000, the number of suspended particles greater than 1 μm in per cubic meter to be less than 8320, the number of suspended particles greater than 1 μm in per cubic foot to be less than 236, the number of suspended particles greater than 5 μm in per cubic meter to be less than 293, or the number of suspended particles greater than 5 μm in per cubic foot to be less than 7 so as to reach the cleanliness of clean room ISO6.

20. The indoor air cleaning system according to claim 1, wherein the gas state in the indoor field has one selected from the group consisting of:

(1) the number of suspended particles greater than 0.5 μm in per cubic meter to be less than 352000, the number of suspended particles greater than 0.5 μm in per cubic foot to be less than 10000, the number of suspended particles greater than 1 μm in per cubic meter to be less than 83200, the number of suspended particles greater than 1 μm in per cubic foot to be less than 2360, the number of suspended particles greater than 5 μm in per cubic meter to be less than 2930, or the number of suspended particles greater than 5 μm in per cubic foot to be less than 70 so as to reach the cleanliness of clean room ISO7;

(2) the number of suspended particles greater than 0.5 μm in per cubic meter to be less than 3520000, the number of suspended particles greater than 0.5 μm in per cubic foot to be less than 100000, the number of suspended particles greater than 1 μm in per cubic meter to be less than 832000, the number of suspended particles greater than 1 μm in per cubic foot to be less than 23600, the number of suspended particles greater than 5 μm in per cubic meter to be less than 29300, or the number of suspended particles greater than 5 μm in per cubic foot to be less than 700 so as to reach the cleanliness of clean room ISO8; and (3) the number of suspended particles greater than 0.5 μm in per cubic meter to be less than 35200000, the number of suspended particles greater than 0.5 μm in per cubic foot to be less than 1000000, the number of suspended particles greater than 1 μm in per cubic meter to be less than 8320000, the number of suspended particles greater than 1 μm in per cubic foot to be less than 236000, the number of suspended particles greater than 5 μm in per cubic meter to be less than 293000, or the number of suspended particles greater than 5 μm in per cubic foot to be less than 7000 so as to reach the cleanliness of clean room ISO9.

21. The indoor air cleaning system according to claim 1, wherein the air conditioning device maintains the temperature and humidity adjustment at a temperature of 25° C.±3° C. and a humidity of 50%±10%.

22. The indoor air cleaning system according to claim 1, wherein the indoor field is further equipped with at least one dust-free aseptic operation cabinet, at least one automatic hand washing and drying machine, at least one biological safety operation cabinet, at least air bath dust room, at least one chemical fume exhaust cabinet or at least one transfer box for clean room operations.

* * * * *